US011549405B2

(12) United States Patent
Radulescu et al.

(10) Patent No.: US 11,549,405 B2
(45) Date of Patent: Jan. 10, 2023

(54) ROCKER ARM ASSEMBLY HAVING LASH MANAGEMENT FOR CYLINDER DEACTIVATION AND ENGINE BRAKE CONFIGURATION

(71) Applicant: Eaton Intelligent Power Limited, Dublin (IE)

(72) Inventors: Andrei Radulescu, Marshall, MI (US); Leighton Roberts, Kalamazoo, MI (US); Ramy Rezkalla, Kalamazoo, MI (US); James R. Sheren, Grand Ledge, MI (US); Mike J. Otto, Kalamazoo, MI (US)

( * ) Notice: Subject to any disclaimer, the term of this patent is extended or adjusted under 35 U.S.C. 154(b) by 0 days.

(21) Appl. No.: 17/382,894

(22) Filed: Jul. 22, 2021

(65) Prior Publication Data

US 2021/0348528 A1 Nov. 11, 2021

Related U.S. Application Data

(63) Continuation of application No. PCT/EP2020/025030, filed on Jan. 24, 2020.
(Continued)

(51) Int. Cl.
*F01L 1/18* (2006.01)
*F01L 13/00* (2006.01)
(Continued)

(52) U.S. Cl.
CPC ..... *F01L 1/181* (2013.01); *F01L 13/0005* (2013.01); *F01L 13/06* (2013.01); *F01L 1/267* (2013.01);
(Continued)

(58) Field of Classification Search
CPC ..... F01L 1/181; F01L 2001/186; F01L 1/267; F01L 13/0005; F01L 2013/001; F01L 13/06; F01L 2303/00
(Continued)

(56) References Cited

U.S. PATENT DOCUMENTS 3,332,405 A * 7/1967 Haviland ..... F01L 13/065 123/182.1
4,911,112 A 3/1990 Oikawa et al.
(Continued)

FOREIGN PATENT DOCUMENTS

CN 207332969 U 5/2018
DE 102013223301 A1 5/2015
(Continued)

OTHER PUBLICATIONS

International Search Report and Written Opinion for International Application No. PCT/EP2020/025030 dated Apr. 24, 2020.

*Primary Examiner* — Jorge L Leon, Jr.
(74) *Attorney, Agent, or Firm* — RMCK Law Group PLC

(57) ABSTRACT

A type III rocker arm assembly operable in a first mode and a second mode based on rotation of a cam shaft includes a rocker shaft and a first rocker arm assembly. The first rocker arm assembly receives the rocker shaft and is configured to rotate around the rocker shaft in the first mode based on engagement with the first cam lobe. The first rocker arm assembly collectively comprises a valve side rocker arm, a cam side rocker arm and a latch pin. The valve side rocker arm defines a valve side rocker arm bore. The cam side rocker arm defines a cam side rocker arm bore. The latch pin assembly is received by the valve and cam side rocker arm bores and selectively couples the valve side rocker arm and the cam side rocker arm for concurrent movement in the first mode.

20 Claims, 19 Drawing Sheets

Related U.S. Application Data

(60) Provisional application No. 62/840,780, filed on Apr. 30, 2019, provisional application No. 62/796,336, filed on Jan. 24, 2019.

(51) Int. Cl.
*F01L 13/06* (2006.01)
*F01L 1/26* (2006.01)

(52) U.S. Cl.
CPC ... *F01L 2001/186* (2013.01); *F01L 2013/001* (2013.01); *F01L 2303/00* (2020.05)

(58) Field of Classification Search
USPC ..... 123/90.39, 90.44
See application file for complete search history.

(56) References Cited

U.S. PATENT DOCUMENTS

| | | | | |
|---|---|---|---|---|
| 5,301,636 | A | 4/1994 | Nakamura | |
| 5,536,089 | A | 7/1996 | Weber et al. | |
| 5,549,081 | A | 8/1996 | Ohlendorf et al. | |
| 5,584,268 | A | 12/1996 | Natkin et al. | |
| 8,851,048 | B2 | 10/2014 | Meistrick | |
| 9,926,816 | B2 | 3/2018 | Ahmed et al. | |
| 2005/0188930 | A1* | 9/2005 | Best | F01L 13/0005 123/90.2 |
| 2006/0236969 | A1* | 10/2006 | Falkowski | F01L 1/053 123/90.27 |
| 2008/0271693 | A1* | 11/2008 | Edelmayer | F01L 13/0005 123/90.44 |
| 2009/0078223 | A1 | 3/2009 | Nakamura | |
| 2014/0182528 | A1* | 7/2014 | Jeon | F01L 1/181 123/90.12 |
| 2014/0251266 | A1* | 9/2014 | Emmons | F02D 13/04 123/321 |
| 2017/0009610 | A1* | 1/2017 | Ahmed | F01L 1/2416 |
| 2017/0198610 | A1* | 7/2017 | Haefner | F01L 1/205 |
| 2017/0284313 | A1* | 10/2017 | Shewell | F01L 13/0026 |
| 2017/0356314 | A1* | 12/2017 | McConville | F01L 13/0005 |
| 2019/0316494 | A1* | 10/2019 | Mariuz | F01L 13/0005 |

FOREIGN PATENT DOCUMENTS

| | | | |
|---|---|---|---|
| EP | 1712748 | B1 | 4/2010 |
| JP | 2014047623 | A | 3/2014 |

* cited by examiner

FIG - 9
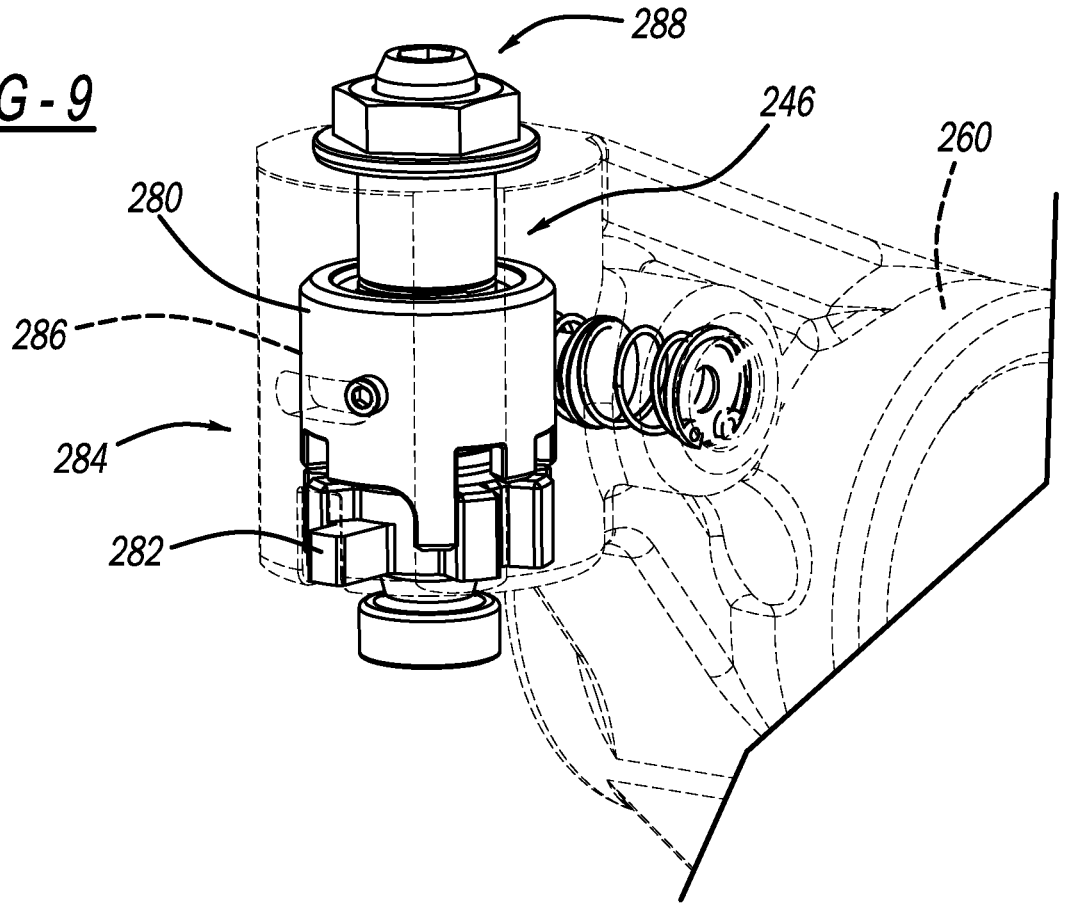
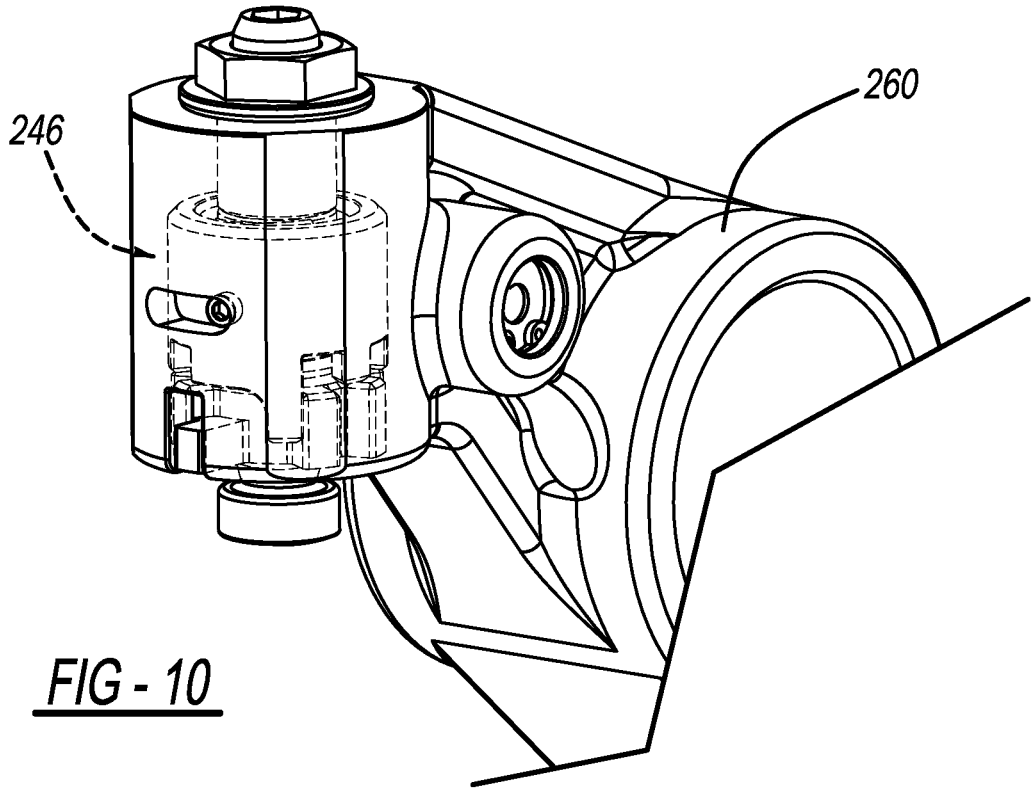
FIG - 10

ROCKER ARM ASSEMBLY HAVING LASH MANAGEMENT FOR CYLINDER DEACTIVATION AND ENGINE BRAKE CONFIGURATION

CROSS REFERENCE TO RELATED APPLICATIONS

This application is a continuation of International Application No. PCT/EP2020/025030 filed Jan. 24, 2020, which claims priority to U.S. Provisional Application Nos. 62/796,336 filed on Jan. 24, 2019 and 62/840,780 filed on Apr. 30, 2019. The disclosures of the above applications are incorporated herein by reference.

FIELD

The present disclosure relates generally to a rocker arm assembly for use in a valve train assembly and, more particularly, to a rocker arm assembly that incorporates cylinder deactivation (CDA) and decompression brake.

BACKGROUND

Compression engine brakes can be used as auxiliary brakes, in addition to wheel brakes, on relatively large vehicles, for example trucks, powered by heavy or medium duty diesel engines. A compression engine braking system is arranged, when activated, to provide an additional opening of an engine cylinder's exhaust valve when the piston in that cylinder is near a top-dead-center position of its compression stroke so that compressed air can be released through the exhaust valve. This causes the engine to function as a power consuming air compressor which slows the vehicle.

In a typical valve train assembly used with a compression engine brake, the exhaust valve is actuated by a rocker arm which engages the exhaust valve by means of a valve bridge. The rocker arm rocks in response to a cam on a rotating cam shaft and presses down on the valve bridge which itself presses down on the exhaust valve to open it. A hydraulic lash adjuster may also be provided in the valve train assembly to remove any lash or gap that develops between the components in the valve train assembly. In some type III rocker arm configurations it is desirable to provide manufacturing solutions to minimize lash variation, latch pin travel and latch contact stress for cylinder deactivation type III rocker arms.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A type III rocker arm assembly operable in a first mode and a second mode based on rotation of a cam shaft includes a rocker shaft and a first rocker arm assembly. The first rocker arm assembly receives the rocker shaft and is configured to rotate around the rocker shaft in the first mode based on engagement with the first cam lobe. The first rocker arm assembly collectively comprises a valve side rocker arm, a cam side rocker arm and a latch pin. The valve side rocker arm defines a valve side rocker arm bore. The cam side rocker arm defines a cam side rocker arm bore. The latch pin assembly is received by the valve and cam side rocker arm bores and selectively couples the valve side rocker arm and the cam side rocker arm for concurrent movement in the first mode and decouples the valve side rocker arm and the cam side rocker arm in the second mode. The latch pin assembly comprises a latch pin, a latch piston, a plug and a biasing member. The latch pin is received by the cam side rocker arm bore. The latch piston is received by the valve side rocker arm bore. The plug selectively translates in the cam side bore to set a retracted position of the latch pin to set latch depth during operation in the second mode. The biasing member biases the latch pin into the valve side rocker arm bore.

According to additional features, the cam and valve side rocker arm bores are of equivalent diameter. The plug can be threaded into the cam side rocker arm bore. A flowable adhesive can be disposed between the plug and the cam side rocker arm bore. The valve side rocker arm bore and the cam side rocker arm bore can be machined in an assembled position.

In other features, the latch piston can define a taper that is configured to urge the latch piston toward the valve side arm when the cam side arm is in relative motion to the valve side arm. The cam side arm can define a chamfer at an engagement end with the taper of the latch piston. The latch pin can define a latch pin taper on an outer diameter thereof. The latch pin taper can include a first taper that tapers toward the valve side arm and a second taper that tapers away from the valve side arm. In one example, the first and second tapers are about eight degrees.

According to still other features, the piston comprises an extension portion that is configured to offset the piston away from an end surface of the valve side bore. The latch pin comprises a stepped diameter having a first diameter portion that is greater than a second diameter portion. The cam and valve side rocker arm bores can be machined concurrently in an assembled position. The second mode can comprise cylinder deactivation. The first rocker arm assembly is an exhaust rocker arm assembly. The type III rocker arm assembly further comprises a second rocker arm assembly configured for selective engine braking.

A type III rocker arm assembly constructed in accordance to additional features of the present disclosure is operable in a first mode and a second mode based on rotation of a cam shaft includes a rocker shaft and a first rocker arm assembly. The first rocker arm assembly receives the rocker shaft and is configured to rotate around the rocker shaft in the first mode based on engagement with the first cam lobe. The first rocker arm assembly collectively comprises a valve side rocker arm, a cam side rocker arm and a latch pin. The valve side rocker arm defines a valve side rocker arm bore. The cam side rocker arm defines a cam side rocker arm bore. The latch pin assembly is received by the valve and cam side rocker arm bores and selectively couples the valve side rocker arm and the cam side rocker arm for concurrent movement in the first mode and decouples the valve side rocker arm and the cam side rocker arm in the second mode. The latch pin assembly comprises a latch pin, a latch piston, and a biasing member. The latch pin is received by the cam side rocker arm bore. The latch piston is received by the valve side rocker arm bore. The biasing member biases the latch pin into the valve side rocker arm bore. The latch piston defines a taper that is configured to urge the latch piston toward the valve side arm when the cam side arm is in relative motion to the valve side arm.

According to additional features, the cam side arm defines a chamfer at an engagement end with the taper of the latch piston. The latch pin defines a latch pin taper on an outer diameter thereof. The latch pin taper comprises a first taper that tapers toward the valve side arm and a second taper that tapers away from the valve side arm. The piston comprises an extension portion that is configured to offset the piston away from an end surface of the valve side bore. The latch pin can comprise a stepped diameter having a first diameter portion that is greater than a second diameter portion. The cam and valve side rocker arm bores can be machined concurrently in an assembled position. The second mode can comprise cylinder deactivation mode. The first rocker arm assembly is an exhaust rocker arm assembly. The type III rocker arm assembly further comprises a second rocker arm assembly configured for selective engine braking.

BRIEF DESCRIPTION OF THE DRAWINGS

The present disclosure will become more fully understood from the detailed description and the accompanying drawings, wherein:

FIG. 9 is a detail view of a mechanical engine brake capsule of the brake rocker arm assembly of FIG. 7;

FIG. 10 is a detail view of an orientation slot of the engine brake capsule of FIG. 7;

FIG. 12 is a side view of the engine brake capsule of FIG. 11 and shown with engine brake ON;

DETAILED DESCRIPTION

The following discussion is set forth in the context of rocker arms for opening exhaust valves configured in a type III compression engine braking system. The discussion focuses on a camshaft having a primary lift cam and an engine brake lift cam. It will be appreciated that the disclosure is not so limited. For example, the present disclosure can also be additionally or alternatively applicable to exhaust valves in other non-compression brake systems. Moreover, the disclosure may also be applicable to intake valves. In this regard, the camshaft can be configured with a primary lift cam and a secondary lift cam. For example, the present disclosure can also be applicable to valvetrains configured for early exhaust valve opening (EEVO), late intake valve closing (LIVC) or other variable valve actuation (VVA) configurations.

Heavy duty (HD) diesel engines with single overhead cam (SOHC) valvetrain requires high braking power, in particular at low engine speed. The present disclosure provides an added motion type de-compression engine brake. To provide high braking power without applying high load on the rest of the valvetrain (particularly the camshaft), the present disclosure provides a dedicated rocker arm for engine brake that acts on one exhaust valve. In this regard, half of the input load is experienced compared to other configurations that have two exhaust valves opening. The following discussion is directed toward a type III valvetrain however various concepts may be applicable to other type valvetrain configurations.

The instant disclosure provides design and manufacturing solutions to minimize the lash variation, latch pin travel and latch contact stress for cylinder deactivation (CDA) type III rocker arms. As will become appreciated from the following discussion, the present design is compact and particularly useful in valvetrain configurations when minimal space is provided for the rocker arm assemblies above the rocker shaft (i.e., between the rocker shaft and the valvetrain cover). In particular, the present disclosure can accommodate all of cylinder deactivation, decompression engine brake and hydraulic lash adjuster valve train elements within small packaging.

Figure 1:
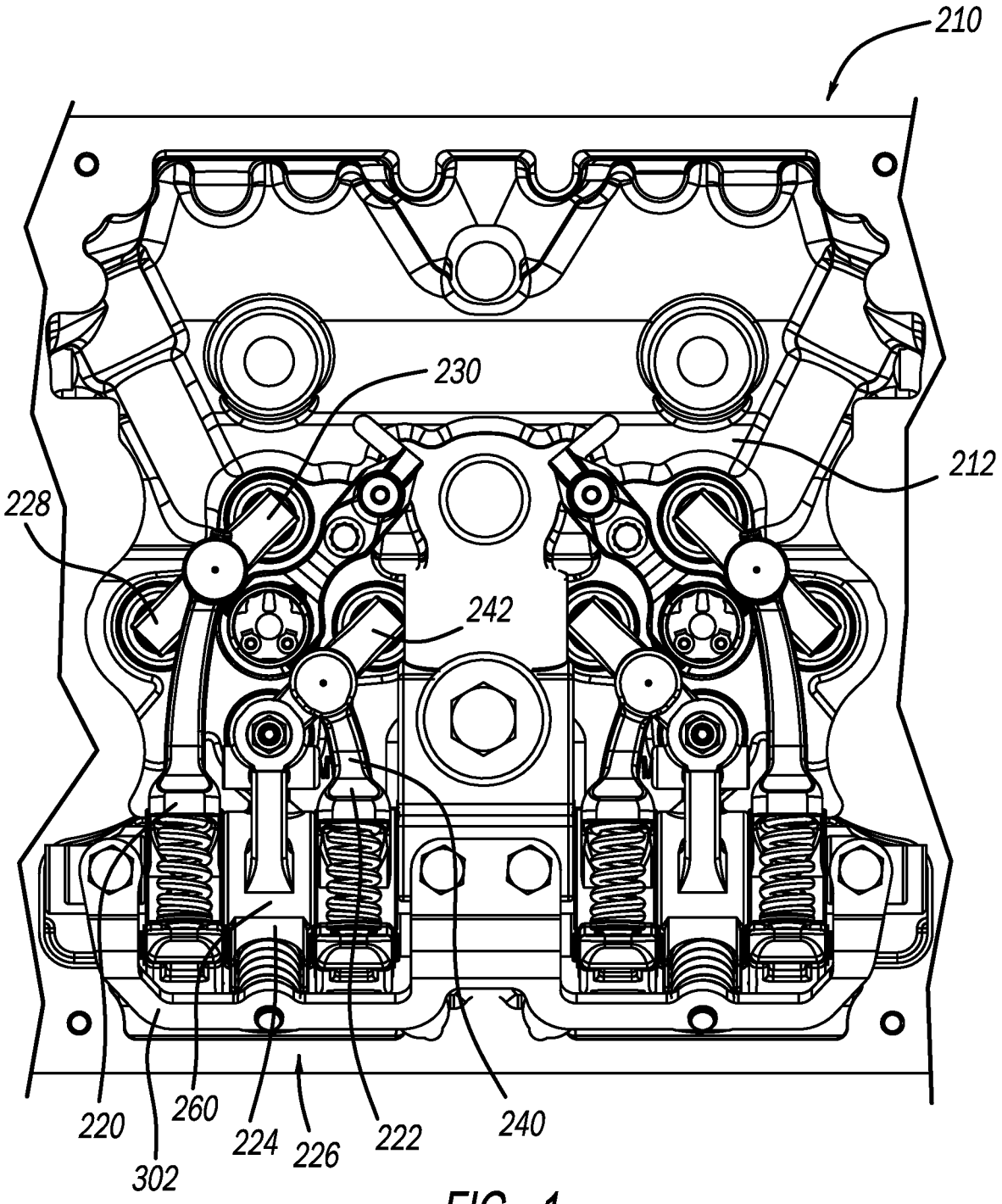
FIG. 1 is a first perspective view of a partial valve train assembly incorporating two pairs of rocker arm assemblies each including an intake rocker arm, an exhaust rocker arm and an engine brake rocker arm constructed in accordance to one example of the present disclosure.

With initial reference to FIG. 1, a partial valve train assembly constructed in accordance to one example of the present disclosure is shown and generally identified at reference 210. The partial valve train assembly 210 utilizes engine braking. It will be appreciated however that the present teachings are not so limited. In this regard, the present disclosure may be used in any valve train assembly that utilizes engine braking or other valvetrains such as those discussed above. The partial valve train assembly 210 is supported in a valve train carrier 212 and can include three rocker arms per cylinder.

Figure 2:
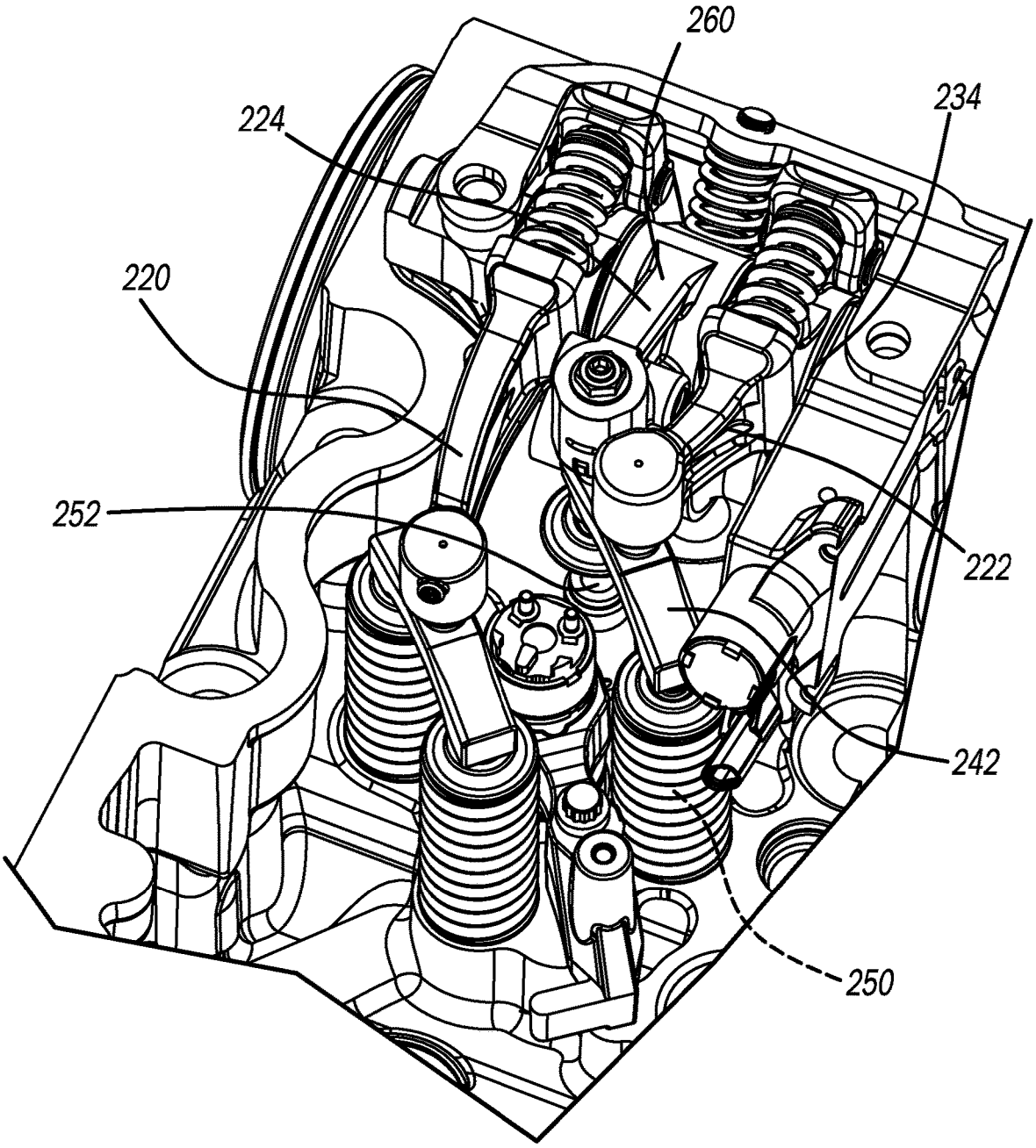
FIG. 2 is a second perspective view of the partial valve train assembly of FIG. 1 and shown with one of the rocker arm assemblies.

Specifically, each cylinder includes an intake valve rocker arm assembly 220, a first or exhaust valve rocker arm assembly 222 and a second or engine brake rocker arm assembly 224. The exhaust valve rocker arm assembly 222 and the engine brake rocker arm assembly 224 cooperate to control opening of the exhaust valves and are collectively referred to as a dual exhaust valve rocker arm assembly 226. The intake valve rocker arm assembly 220 is configured to control motion of intake valves 228, 230. The exhaust valve rocker arm assembly 222 is configured to control exhaust valve motion in a drive mode. The engine brake rocker arm assembly 224 is configured to act on one of the two exhaust valves in an engine brake mode as will be described herein. A rocker shaft 234 (FIG. 2) is received by the valve train carrier 212 and supports rotation of the exhaust valve rocker arm assembly 222 and the engine brake rocker arm assembly 224.

Figure 6:
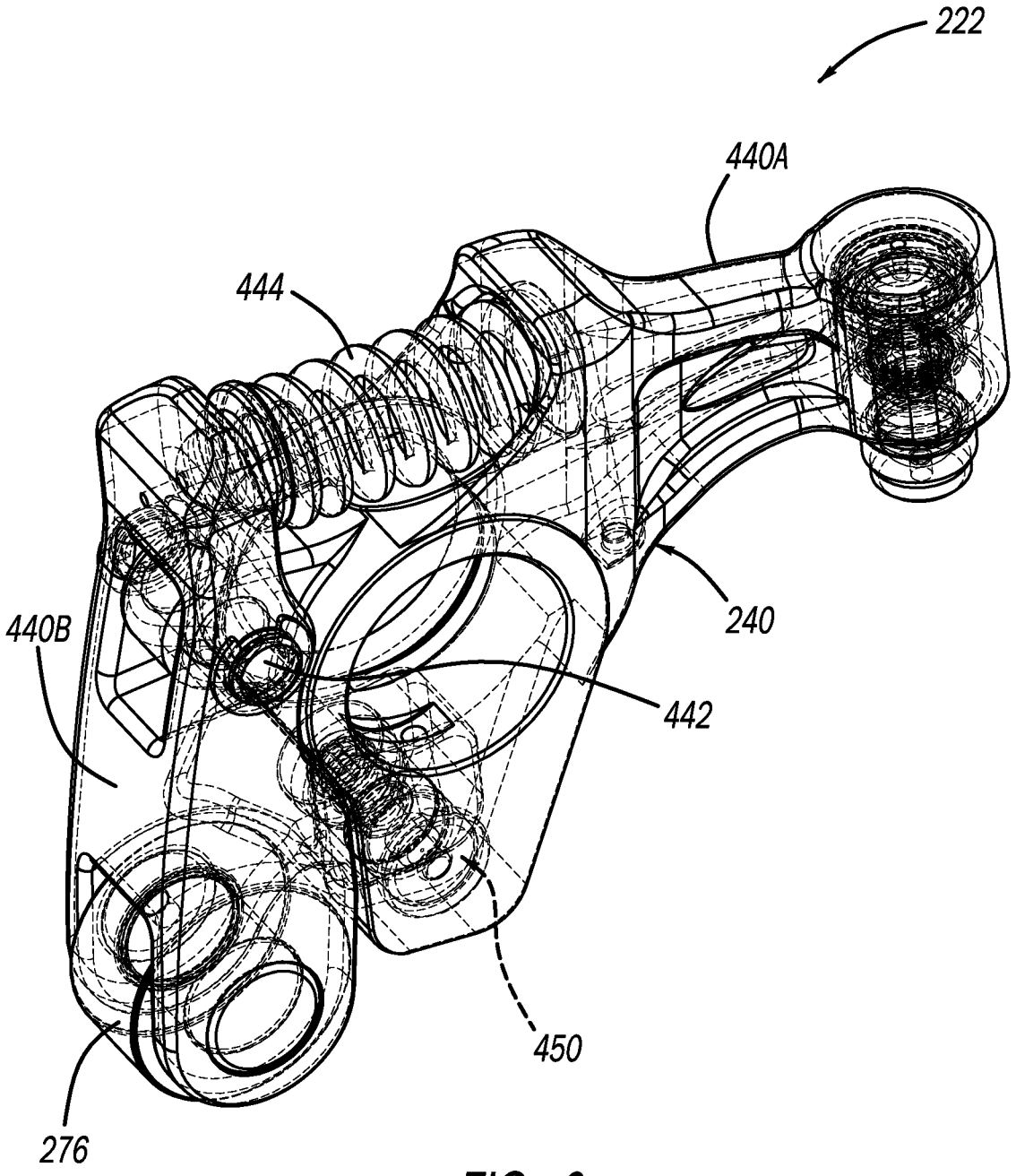
FIG. 6 is a front view a deactivating exhaust rocker arm assembly of FIG. 1.
Figure 7:
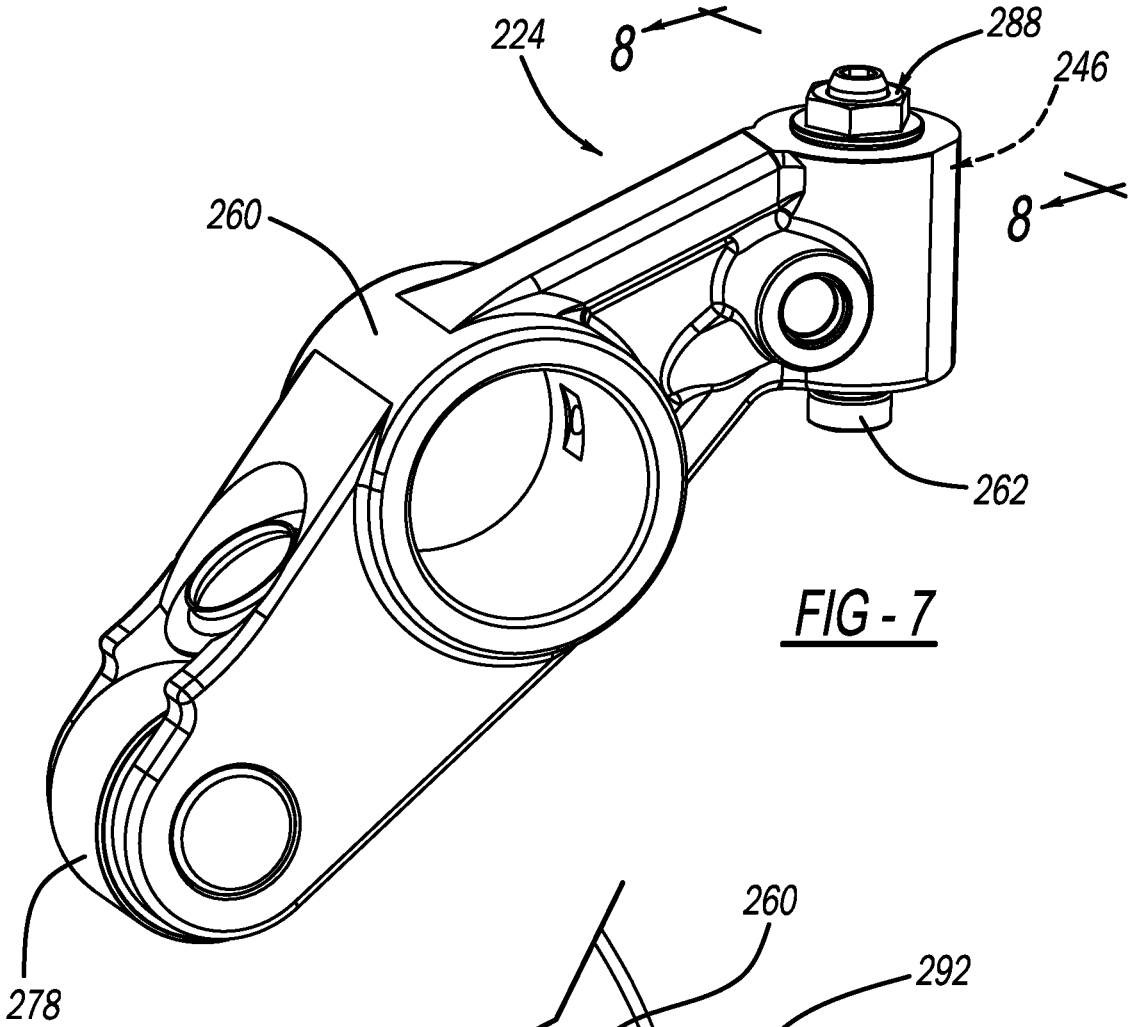
FIG. 7 is a perspective view of a brake rocker arm assembly of FIG. 1.
Figure 8:
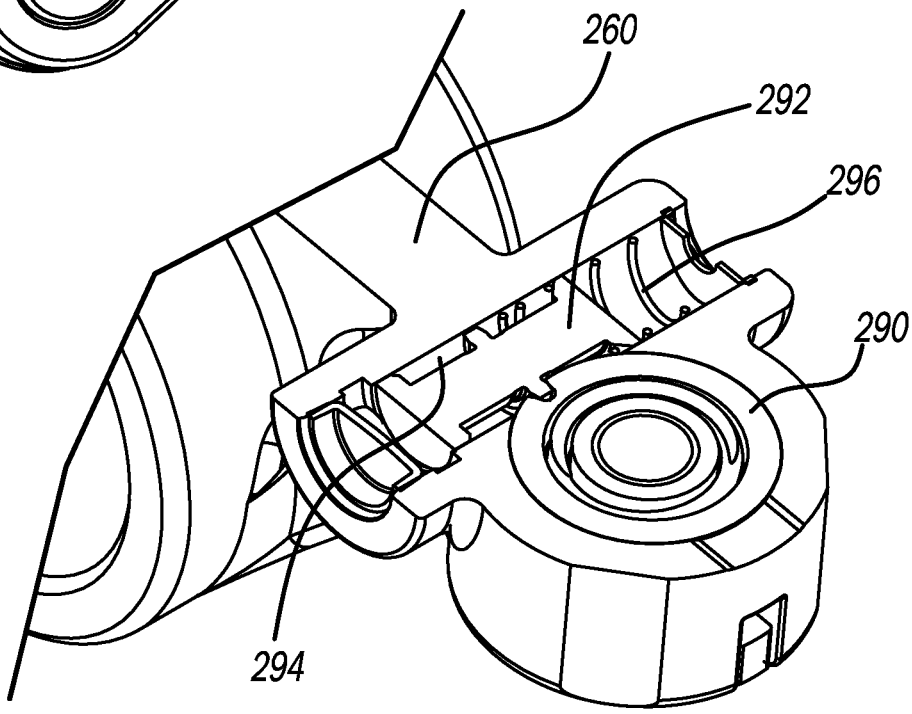
FIG. 8 is a sectional view of the brake rocker arm assembly taken along lines 8-8 of FIG. 7.

With continued reference to FIG. 1 and additional reference to FIG. 6, the exhaust valve rocker arm assembly 222 can generally include an exhaust side rocker arm 240A, a cam side rocker arm 240B, and a valve bridge 242. The engine brake rocker arm assembly 224 can include the engine brake rocker arm 260 having an engaging portion 262 (FIG. 7). The valve bridge 242 engages a first and second exhaust valve 250 and 252 (FIG. 3) associated with a cylinder of an engine (not shown).

Figure 3:
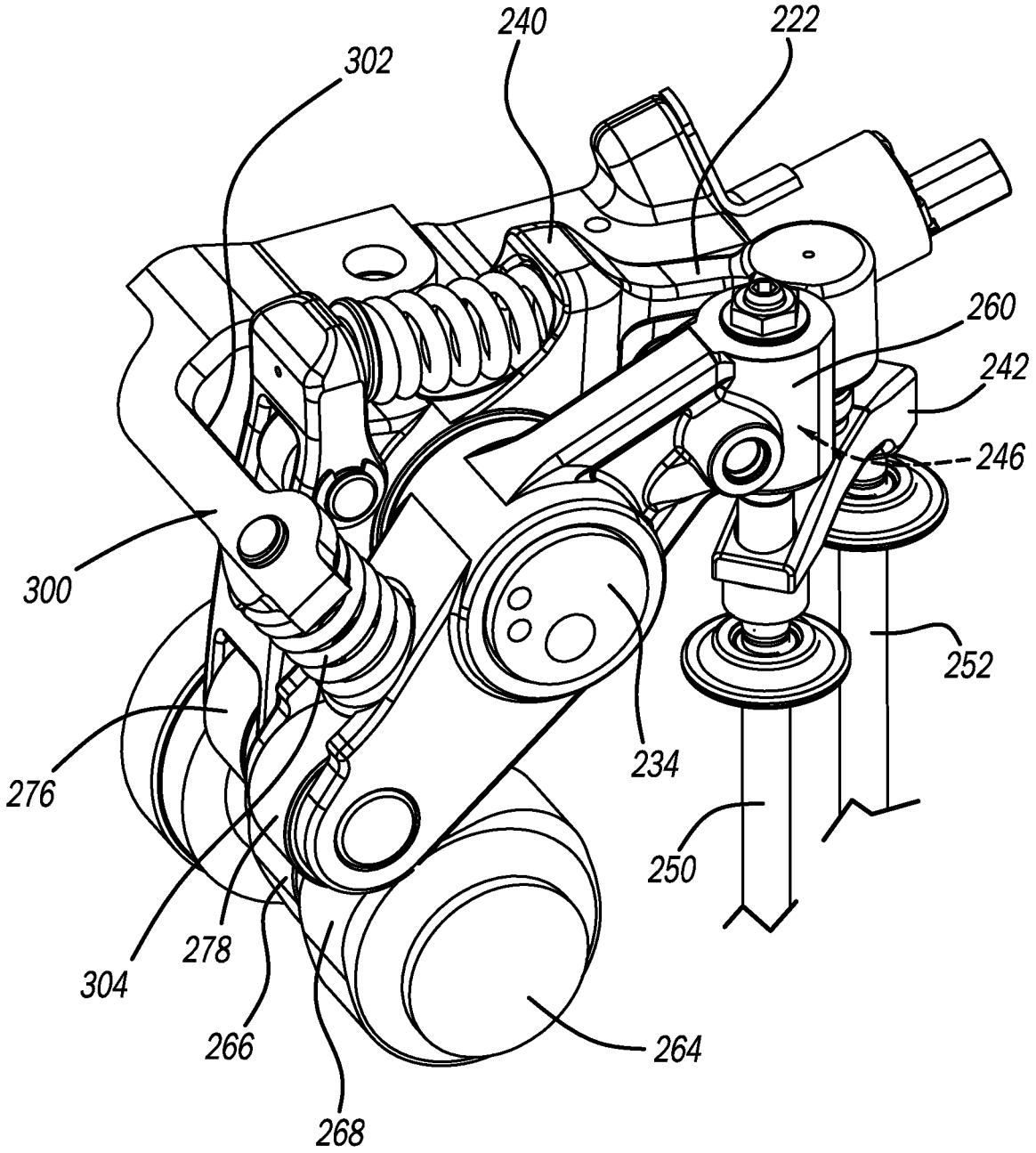
FIG. 3 is a first perspective view of the engine brake rocker arm and associated biasing assembly.

With reference now to FIG. 3, a camshaft 264 includes an exhaust main lift cam lobe 266 and an engine brake cam lobe 268. The exhaust rocker arm 240 has a first roller 276. The engine brake rocker arm 260 has a second roller 278. The first roller 276 rotatably engages the exhaust main lift cam lobe 266. As will be described in greater detail herein, the second roller 278 is configured to selectively rotatably engage the engine brake cam lobe 268. The exhaust rocker arm 240 rotates around the rocker shaft 234 based on a lift profile of the exhaust main lift cam lobe 266. The engine brake rocker arm 260 rotates around a rocker shaft 234 based on a lift profile of the engine brake cam lobe 268.

Figure 4:
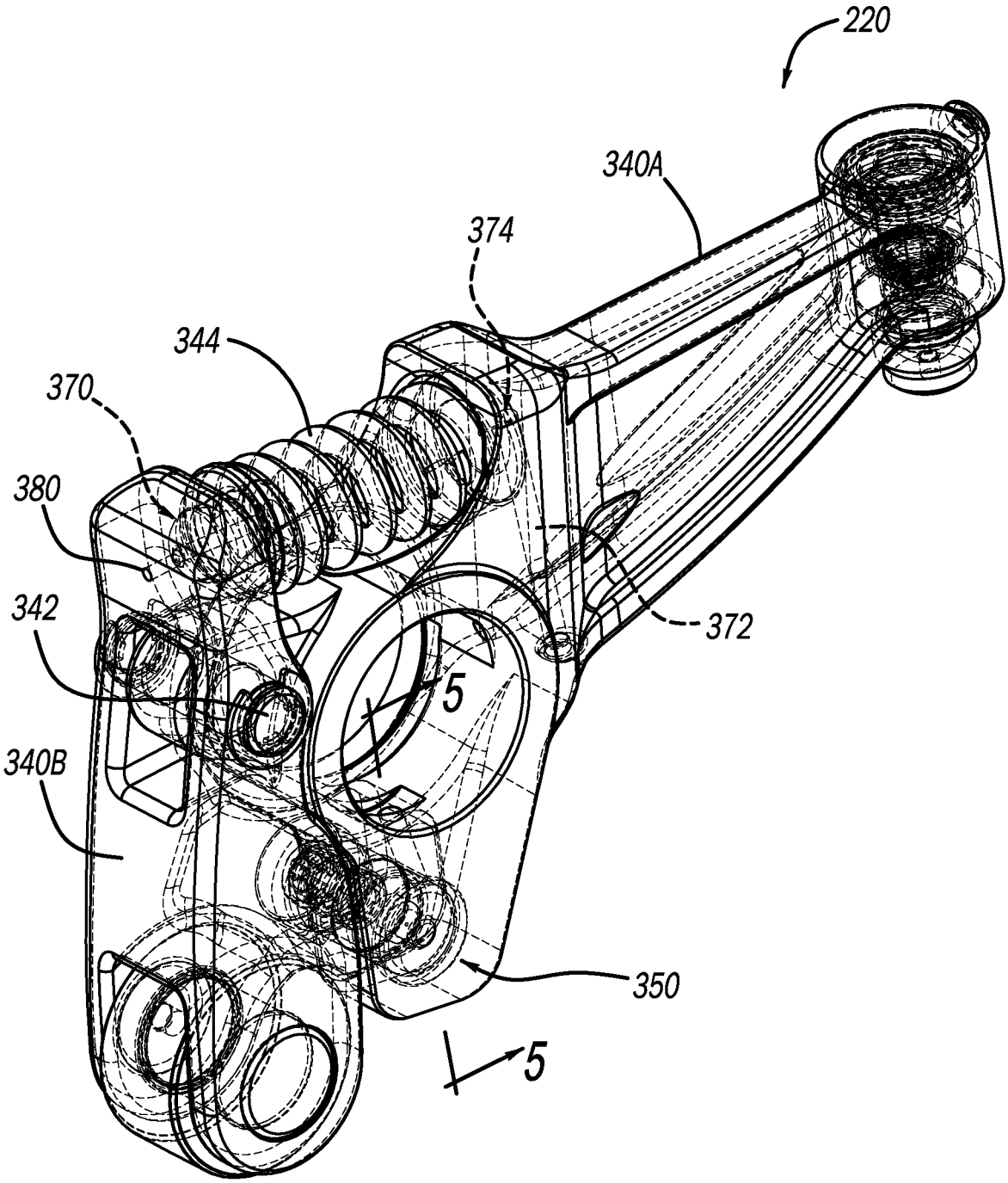
FIG. 4 is perspective view of a deactivating intake rocker arm assembly of FIG. 1.
Figure 5:
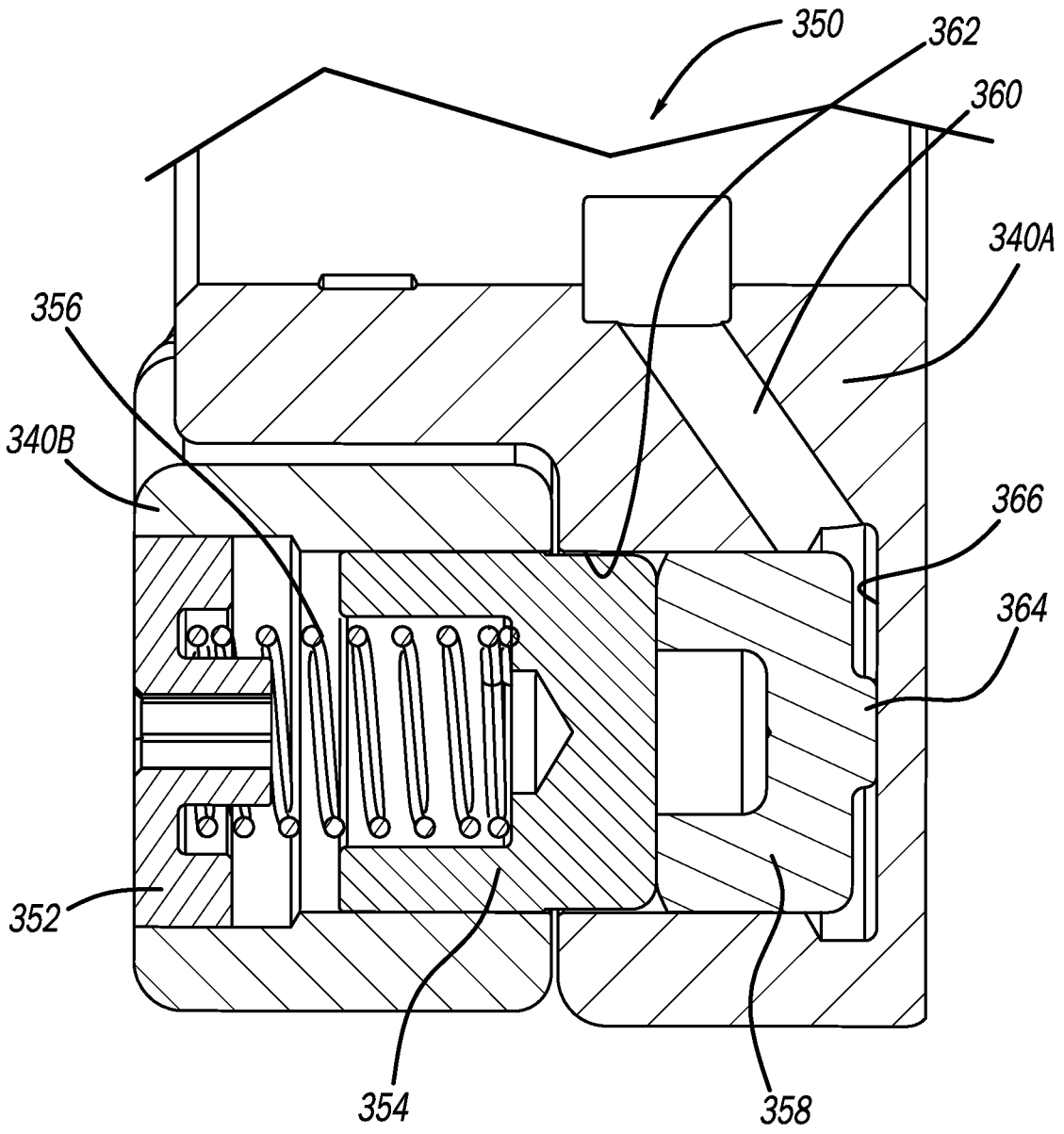
FIG. 5 is a cross sectional view of a latch assembly of the deactivating rocker arm assembly of FIG. 4.
Figure 11:
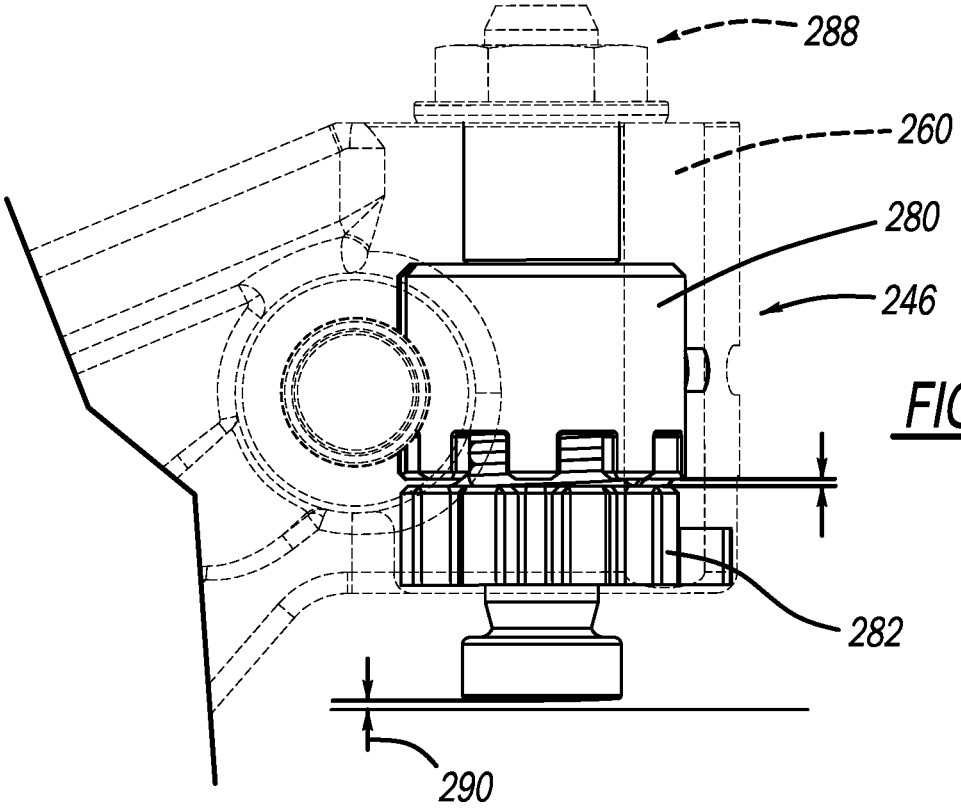
FIG. 11 is a side view of the engine brake capsule of FIG. 9 and showing lash between the upper and lower capsule and between the engine brake capsule and the bridge.
Figure 12:
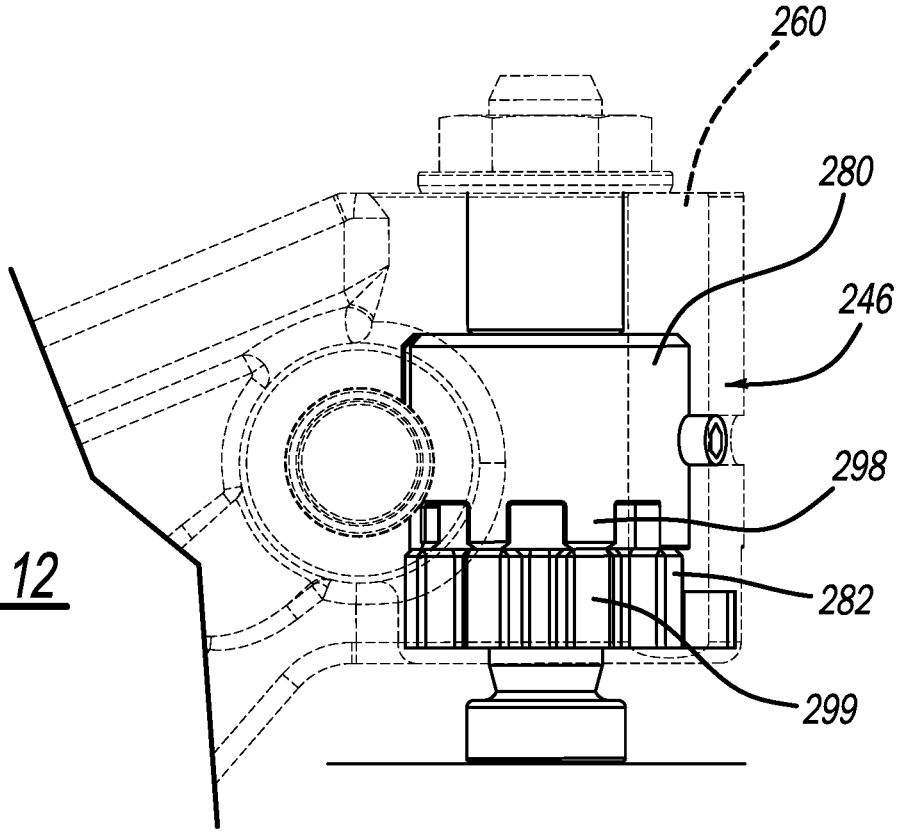
Figure 13:
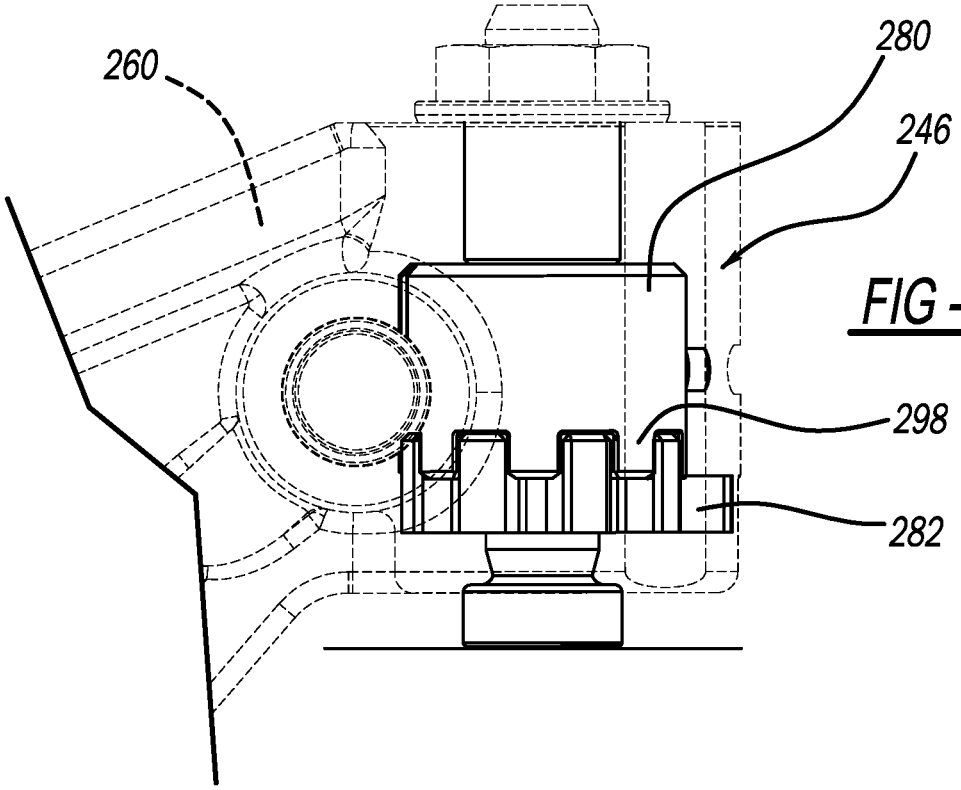
FIG. 13 is a side view of the engine brake capsule of FIG. 12 and shown with engine brake OFF.

With additional reference now to FIGS. 3-5, the engine brake rocker arm 260 includes an engine brake capsule 246. In general, the engine brake capsule 246 includes an upper and lower capsule 280 and 282 respectively. The upper and lower capsules 280 and 282 collectively provide a castellation mechanism 284. The engine castellation mechanism 284 is disposed within a bore 286 formed in the rocker arm engine brake rocker arm 260. A mechanical lash adjuster 288. The lash adjuster 288 can be used to adjust the 290 (FIG. 11). A plunger 292 is configured to rotate the upper capsule 280 relative to the lower capsule to switch the engine brake capsule 246 between a locked position (FIG. 12) and an unlocked position (FIG. 13). In the example shown, the plunger 292 is configured to translate within a bore 294 upon introduction of hydraulic fluid into the bore 294 such that the plunger 292 translates against the bias of biasing member 296.

The engine brake capsule 246 is movable between a brake inactive position and a brake active position via actuation of the plunger 292. In the brake unlocked, inactive position (FIG. 13), stepped projections 298 of the upper capsule 280 are aligned with gaps in the lower capsule 282 such that the upper capsule 280 slides inside the lower capsule 282 and the engine brake capsule 246 collapses. In the locked, brake active position (FIG. 12), the plunger 292 translates causing the upper capsule 280 to rotate causing stepped projections 298 align with fingers 299 on the lower capsule 282. Additional description of the engine brake capsule 246 and operation thereof may be found in commonly owned PCT patent application PCT/US2018/045956 filed on Aug. 9, 2018, the contents of which are expressly incorporated herein for reference.

The engine brake rocker arm assembly 224 includes a biasing assembly 300 that cooperates with the engine brake rocker arm 260 to bias the engine brake rocker arm 260 to accommodate mechanical lash. The biasing assembly 300 can include a reaction bar 302 and a biasing member 304. The biasing member 304 biases the engine brake rocker arm 260 toward the camshaft 264.

With additional reference now to FIGS. 4 and 5, the intake valve rocker arm assembly 220 will be described. The intake valve rocker arm assembly 220 can generally include an intake side rocker arm 340A, a cam side rocker arm 340B, a pivot pin 342, a biasing member 344 and a latch pin assembly 350 that selectively couples the intake side rocker arm 340A and the cam side rocker arm 340B. The latch pin assembly 350 includes a plug 352, a latch pin 354, a biasing member 356 and a piston 358. The latch pin assembly 350 can be actuated by any method.

As will be described, when in lift mode, the latch pin 354 and piston 358 occupy a position shown in FIG. 5. When in lift mode, no hydraulic fluid is delivered through passage 360. In this regard, the biasing member 356 biases the latch pin 354 and piston 356 rightward as shown in FIG. 5 causing the latch pin 354 to locate within bore 362 thereby locking the cam side rocker arm 340B to the intake side rocker arm 340A for concurrent rotation. When in a decoupled mode (such as cylinder deactivation mode), hydraulic fluid is delivered through the passage 360. In this regard, the piston 358 and the latch pin 354 translate leftward against the bias of the spring 356 to a position where the latch pin 354 is not located within the bore 362 (see also FIG. 16).

Of note, the piston 358 has an extension portion 364 that inhibits gauge blocking. Explained further, when fluid is delivered through passage 360, it can flow to areas adjacent a face of the piston 358 because the extension portion 364 offsets the piston 358 away from an end surface 366 of the blind bore 362 of the intake side rocker arm 340A (minimizing surface area of opposing and engaged flat surfaces that can encourage the piston 358 from sticking to the end surface 366 of the blind bore). Additionally, the surface finish at the interface of the piston 358 and the end surface 366 of the blind bore can be rough or non-smooth. When in the decoupled mode, rotation of the camshaft 264 causes rotation of the cam side rocker arm 340B but not rotation of the intake side rocker arm 340A. In this way, the cam side rocker arm 340B rotates about the pivot pin 342 against the bias of the biasing member 344 without imparting any motion onto the intake side rocker arm 340A and therefore without imparting any motion onto the intake valves 228, 230.

With reference now to FIG. 4, the intake rocker arm assembly 220 includes a lubrication system that lubricates a funnel 370 provided on the cam side rocker arm 340B. In particular, a channel 372 defined in the intake side rocker arm 340A receives fluid from the oil gallery that feeds the HLA. Fluid is routed through the channel 372 and out a small opening 374. The fluid exiting the opening 374 is directed toward the funnel 370 where it lubricates an interface between the funnel 370, the cam side rocker arm 340B and the biasing member 344. Excess fluid exits the cam side rocker arm from a small opening 380. This lubrication system is also included in the remaining rocker arm assemblies as well.

With reference now to FIG. 6, the exhaust valve rocker arm assembly 222 will be described. The exhaust valve rocker arm assembly 222 can generally include an exhaust side rocker arm 440A, a cam side rocker arm 440B, a pivot pin 442, a biasing member 444 and a latch pin assembly 450 that selectively couples the exhaust side rocker arm 440A and the cam side rocker arm 440B. The latch pin assembly 450 includes a plug, a latch pin, a biasing member and a piston similar to described above with respect to the latch pin assembly 350.

Figure 14:
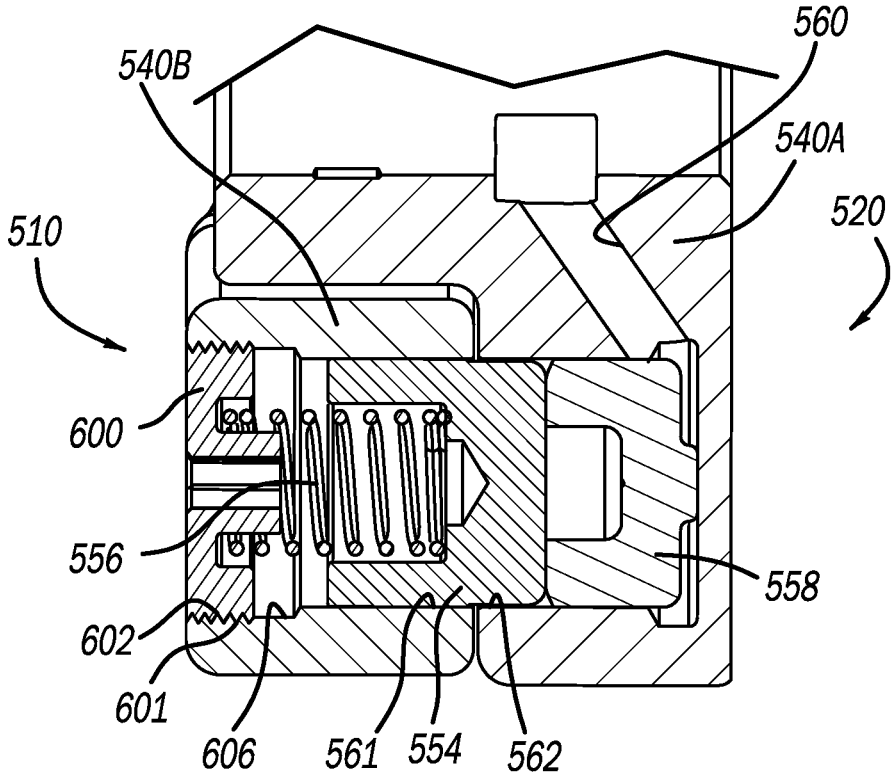
FIG. 14 is a cross sectional view of a latch assembly of the deactivating rocker arm assembly shown in lift mode (latch engaged)
Figure 15:
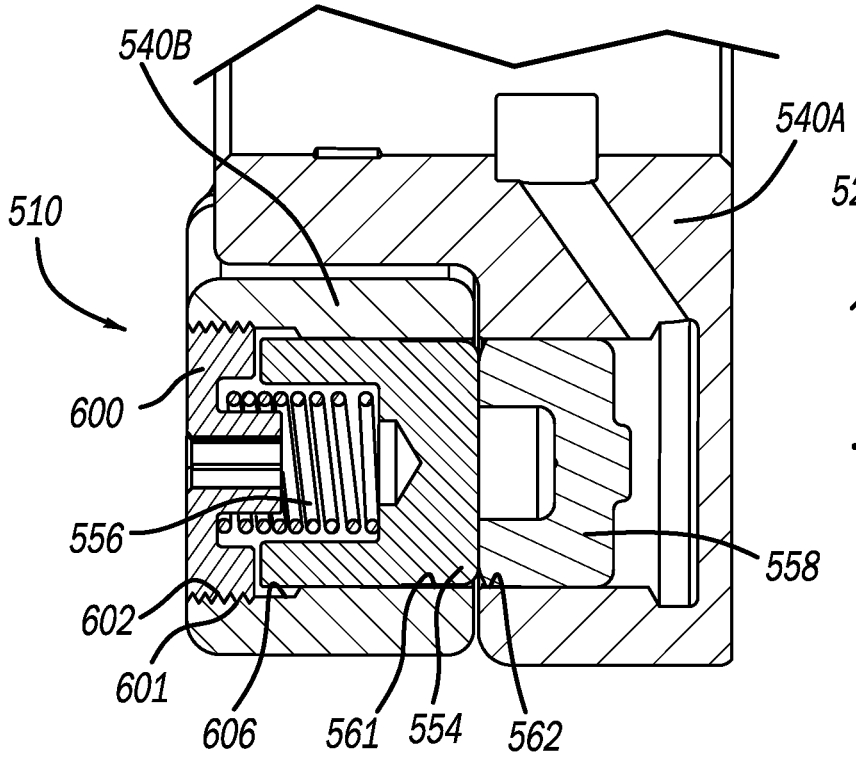
FIG. 15 is a cross sectional view of the latch assembly of FIG. 14 and shown in transition (cam on base circle, latch retracted)
Figure 16:
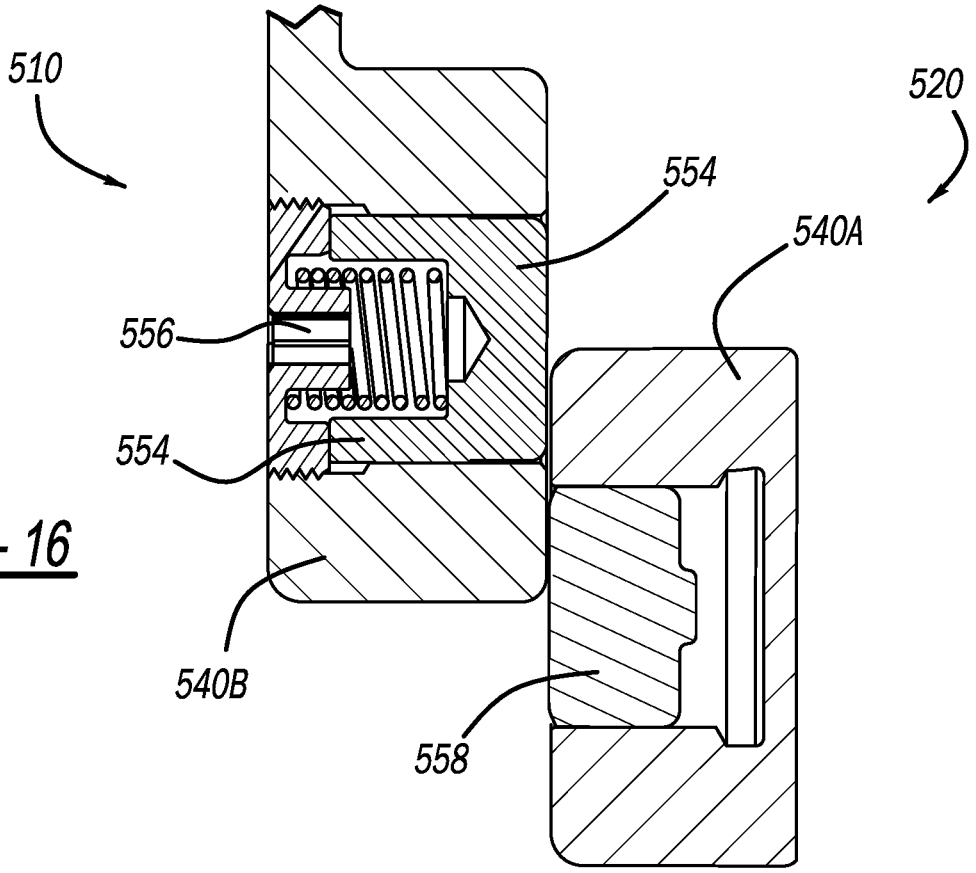
FIG. 16 is a cross sectional view of the latch assembly of FIG. 15 and shown during cylinder deactivation (max lost motion)

Turning now to FIGS. 14-18 additional features of the present disclosure will be described. It will be understood that the latch pin assembly 450 on the exhaust valve rocker arm assembly 222 operates similarly to the latch pin assembly 350 on the intake valve rocker arm assembly 220. In this regard, a latch pin assembly 510 is described below with the appreciation that the latch pin assembly 510 can be configured for either of the exhaust valve rocker arm assembly 222 or the intake valve rocker arm assembly 220. A latch pin assembly 510 is shown in FIGS. 14-18 disposed in a rocker arm assembly 520 having a valve side arm 540A and a cam side arm 540B. The latch pin assembly 510 includes a latch pin 554, a biasing member 556 and a piston 558. The rocker arm assembly 520 having the latch pin assembly 510 can be an intake rocker arm or an exhaust rocker arm assembly. FIG. 14 illustrates the latch pin assembly 510 during lift mode with the latch pin 554 engaged. In the lift mode, no hydraulic fluid is delivered through bore 560. In this regard, the biasing member 556 biases the latch pin 554 and the piston 558 rightward causing the latch pin 554 to translate within first latch bore 561 (FIG. 17) of the cam side arm 540B to a position wherein the latch pin 554 also locates partially within second latch bore 562 of the valve side arm 540A thereby locking the valve side and cam side arms 540A, 540B for concurrent rotation. FIG. 15 illustrates the latch pin assembly 510 during transition with the cam on the base circle and the latch pin 554 retracted. FIG. 16 illustrates the latch pin assembly 510 during CDA mode with maximum lost motion. As can be appreciated, the piston 558 cannot extend into the cam side arm 540B. Latch length and cam side arm pocket length is critical to determine latch piston position in CDA mode.

Figure 17:
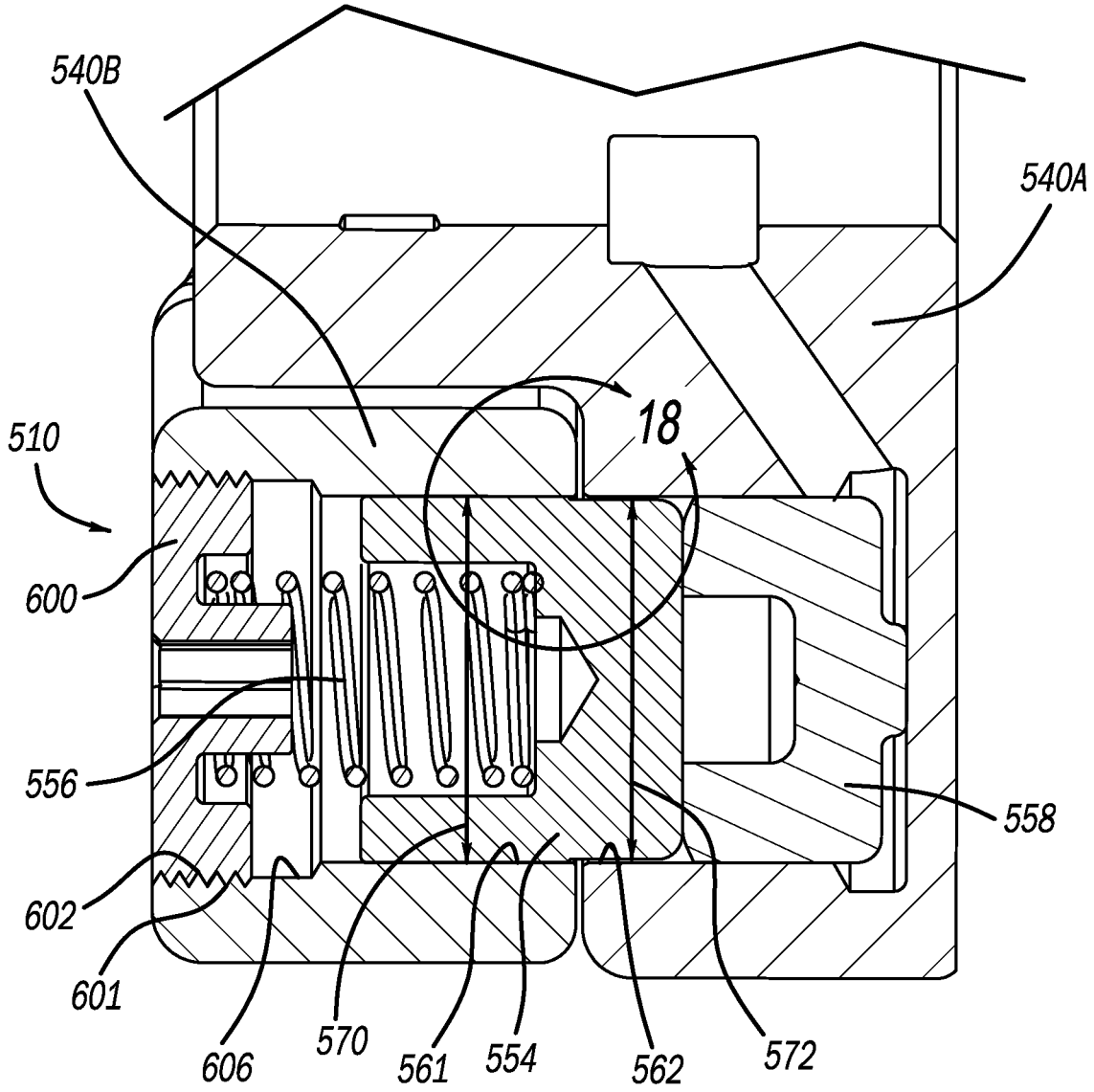
FIG. 17 is a cross sectional view of a latch assembly of the deactivating rocker arm assembly of the present disclosure and shown identifying a first outer diameter and a second outer diameter of the latch, the latch assembly having a threaded plug that closes the end of the latch bore and that is used to set the latch depth in CDA for a controlled distance between the cam side arm and the latch.
Figure 18:
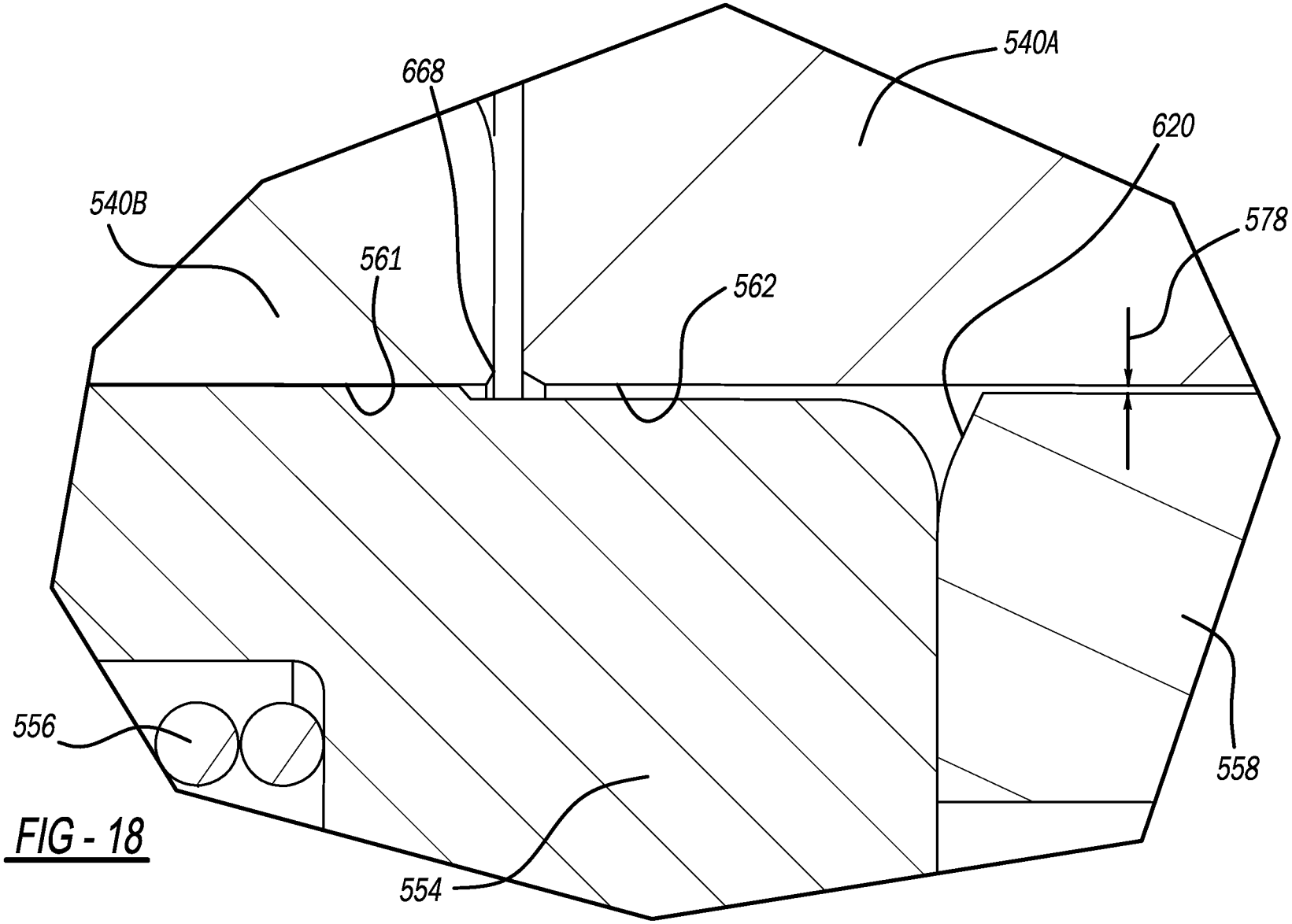
FIG. 18 is a detail view of the cam side arm, valve side arm, latch and latch piston of FIG. 17.

With particular reference to FIGS. 17 and 18 additional features will be described. The latch pin 554 can define a first outer diameter 570 and a second outer diameter 572. In this regard the latch pin 554 can have a stepped diameter. Latch lash variation 578 shall be minimized to maintain the engine performance. Latch lash is needed to ensure latch pin 554 will engage the valve side arm for the life of the engine including when wear occurs.

Figure 20A:
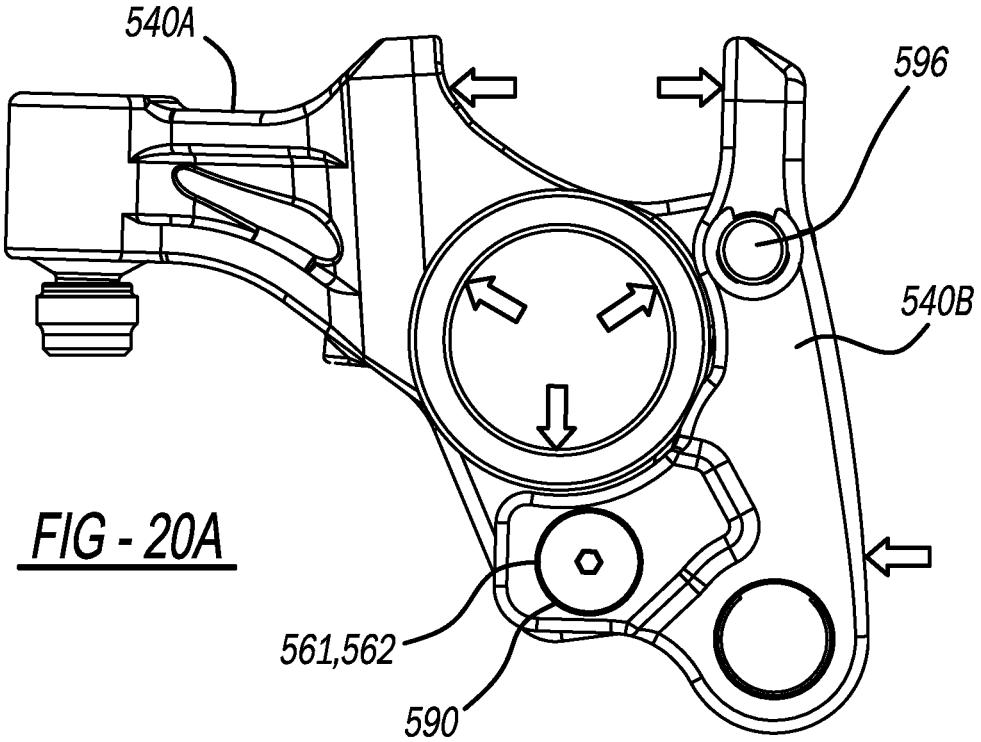
FIG. 20A is a side view of the rocker arm assembly of the present disclosure shown positioned for machining according to one example of the present disclosure.
Figure 20B:
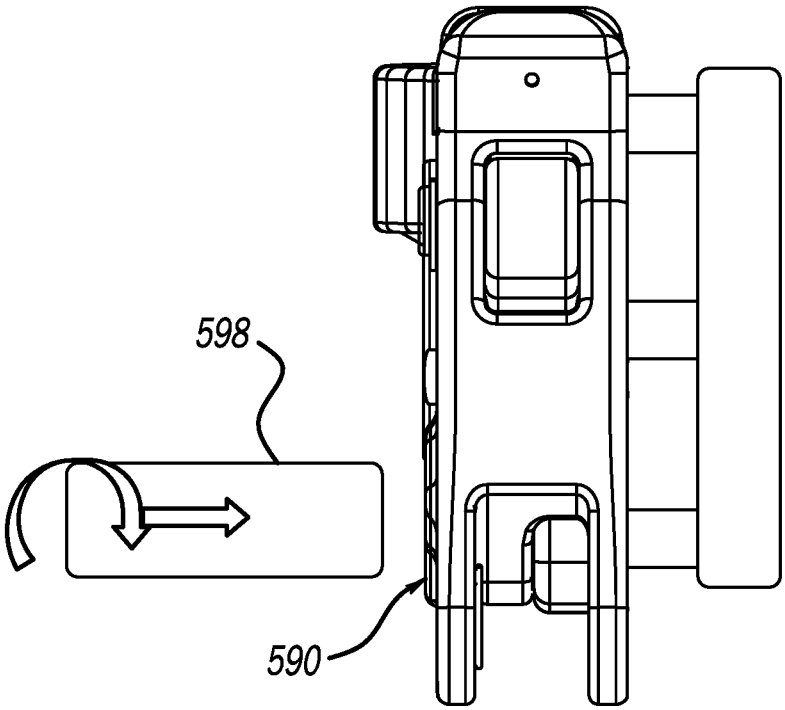
FIG. 20B is an end view of the rocker arm assembly shown with a ream, grinding wheel or finishing tool used to finish both latch bores at the same inner diameter according to one machining method of the instant application.

The present disclosure provides a solution to achieve desirable latch lash and coaxiality of the latch bores 561, 562 for a type III rocker arm configuration. The instant disclosure mitigates part to part variation to maintain the latch lash under control without select tip for latch pins. In some prior art arrangements, latch pins and/or latch bores are ground in categories to maintain the latch lash. Turning now to FIGS. 20A and 20B, latch bores, collectively referenced at 590, including latch bore 561 on cam side arm 540B and latch bore 562 on the valve side arm 540A can be machined in the assembled position and under the same load that the rocker arm assembly 520 experiences in the engine when intended to switch modes (lift to CDA and vice versa). That process will set the clearance at the pivot pin 596 and deflect the arms in the same way to replicate during application. A finishing tool 598 (reamer, grinding wheel, or other tool) will finish both latch bores 561, 562 at the same inner diameter in perfect alignment to each other. Part to part variability is mitigated by machining the latch bores 561, 562 concurrently in one operation with one tool. Desired lash requirement can be achieved with one latch pin category.

It is desirable to minimize the distance between the latch pin 554 and the valve side arm 540A when the rocker arm assembly 520 is in CDA mode. In some prior art configurations, the bore 562 of the valve side arm 540A has a larger inner diameter than the bore 561 of the cam side arm 540B to preclude entry of the latch piston 558 into the bore 561. In the present teachings however, the bores 561 and 562 have equivalent inner diameters. According to the present disclosure, a threaded plug 600 (FIG. 17) having threads 601 is disposed into a complementarily threaded bore 602 defined in the cam side arm 540B. The threaded plug 600 can close the end of the latch bore 606. The plug 600 can be adjusted linearly to set the latch depth in CDA to remain inside the cam side arm 540B (exclusively within latch bore 561, or flush with the cam side arm, see also FIG. 16) when the latch pin 554 is retracted removing the variability of the latch and bore length from the stack up. Adhesive such as Loctite™ can be disposed onto the plug threads 601 to retain the threaded plug 600 relative to the threads 602. The threaded plug 600 can be replaced with an expandable cup plug. A press-fit, weld, other mechanical or chemical means are required to retain the plug 600 in function.

Figure 19:
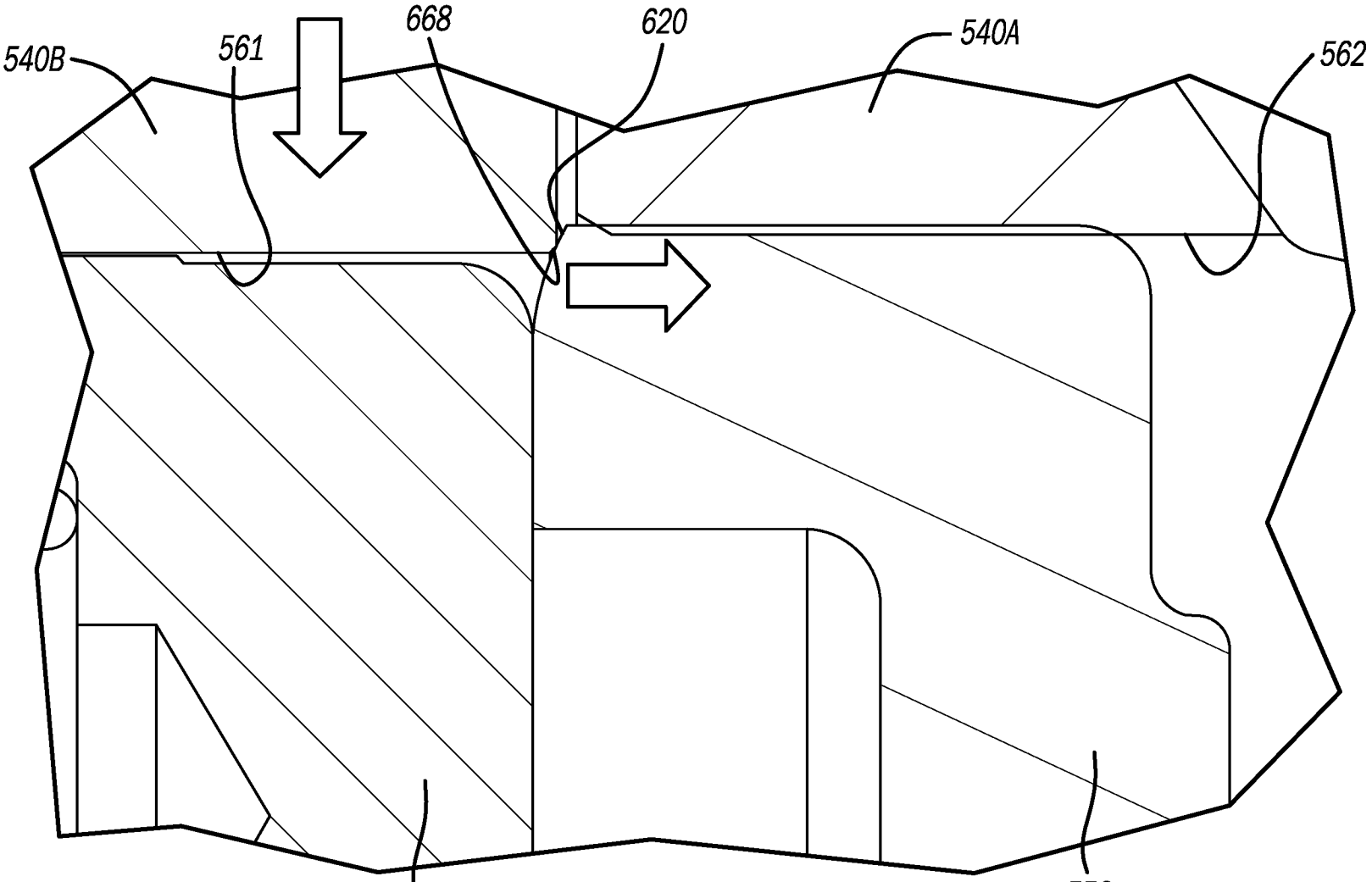
FIG. 19 is a detail cross sectional view of the latch assembly according to additional features and shown with a latch piston having a tapper portion and rounds to push back the latch piston with the cam side arm is in relative motion to the valve side arm (CDA mode)

It is further desirable to avoid the latch piston 558 to be caught by the cam side arm 540B when the rocker arm assembly 520 is in CDA mode. As viewed in FIG. 19, the latch piston 558 can include a taper 620 to push back the latch piston 558 toward the valve side arm 540A when the cam side arm 540B is in relative motion to the valve side arm 540A (CDA mode). The cam side arm 540B can have a chamfer 668 (see also FIG. 19). The chamfer 668 on the cam side arm 540B and the taper 620 can encourage the latch piston 558 to be urged back into the bore 562.

Figure 21A:
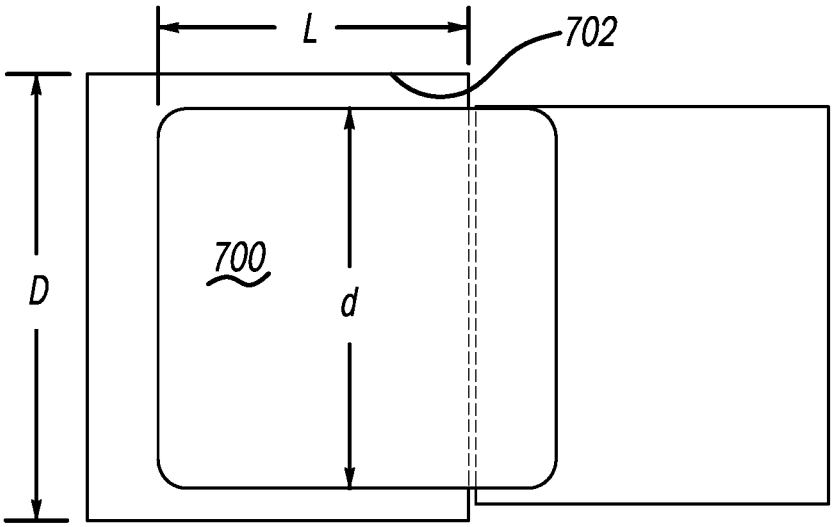
FIG - 21A Prior Art
FIG. 21A illustrates a prior art latch and valve side arm bore.
Figure 21B:
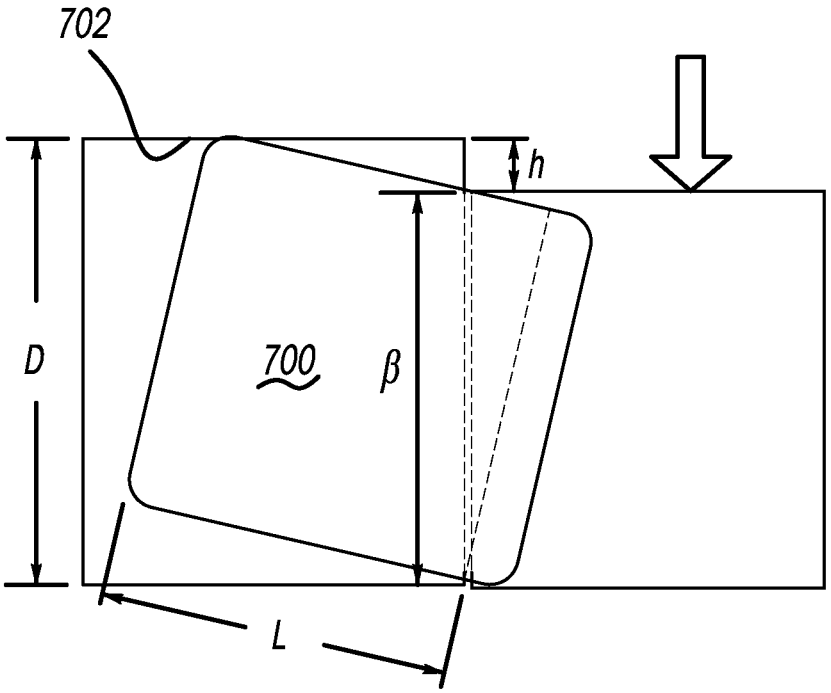
FIG - 21B Prior Art
FIG. 21B illustrates the prior art latch and valve side arm bore of FIG. 21A and showing narrow contact surfaces to take up high loads.
Figure 22:
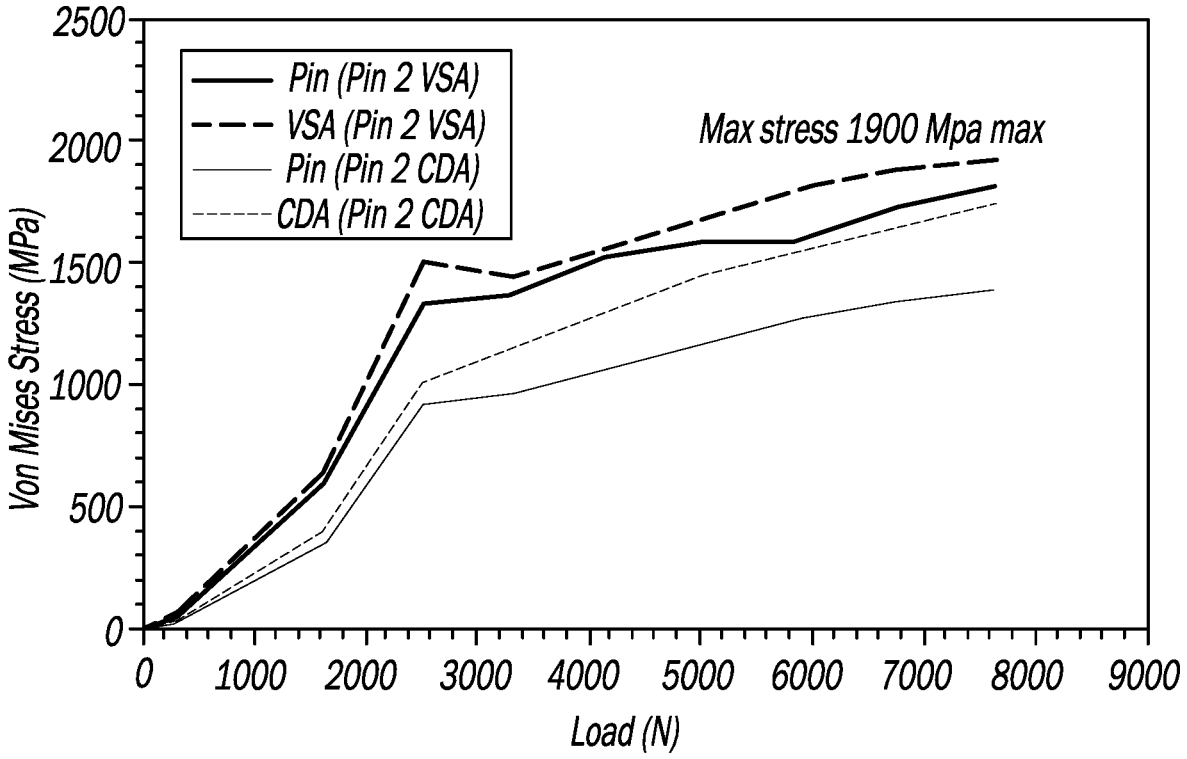
FIG - 22 Prior Art
FIG. 22 is a subsurface stress based on load for the prior art configuration of FIG. 21A.

With reference to FIGS. 21A and 21B, a prior art example latch 700 will be described. Due to latch lash, when the latch 700 is loaded it will tilt inside the latch bores 702. Such a condition can result in reduced contact between the latch 700 and the bore 702. The reduced contact surface increases the contact stress above recommended values as illustrated in FIG. 22. An aggregating factor is the tilting of the cam side arm versus the valve side arm due to the overturn of the rocker arm.

Figure 23:
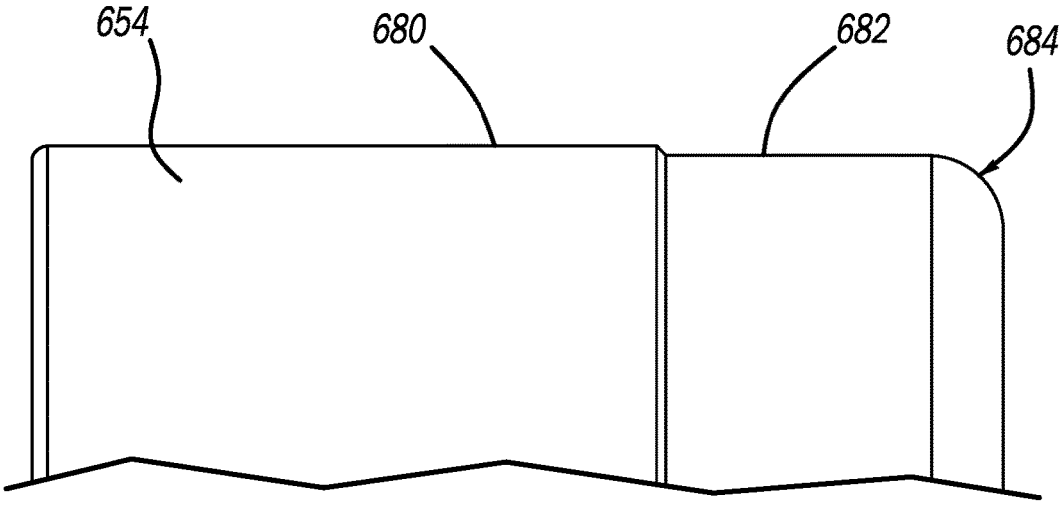
FIG. 23 is a close up view of a latch pin according to one example of the present disclosure and shown with a small tilt on the outer diameter.
Figure 24:
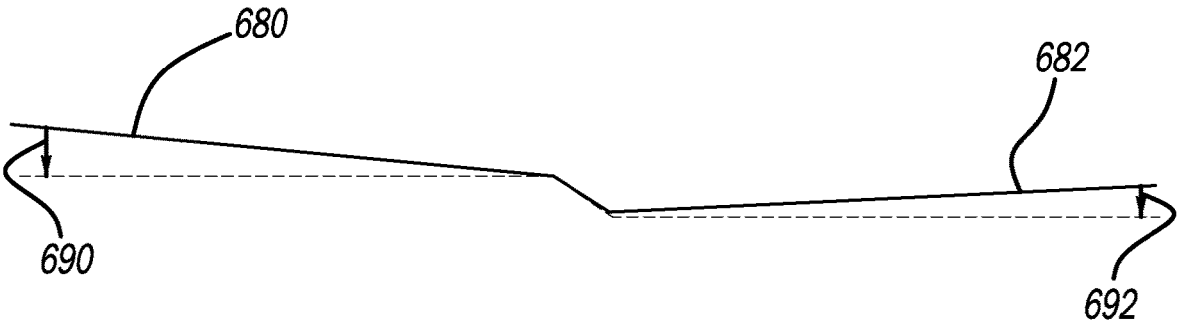
FIG. 24 is a detail view of the outer diameter of the latch pin of FIG. 25 and shown with a latch pin outer diameter of about 0.8 degrees on both diameters.
Figure 25:
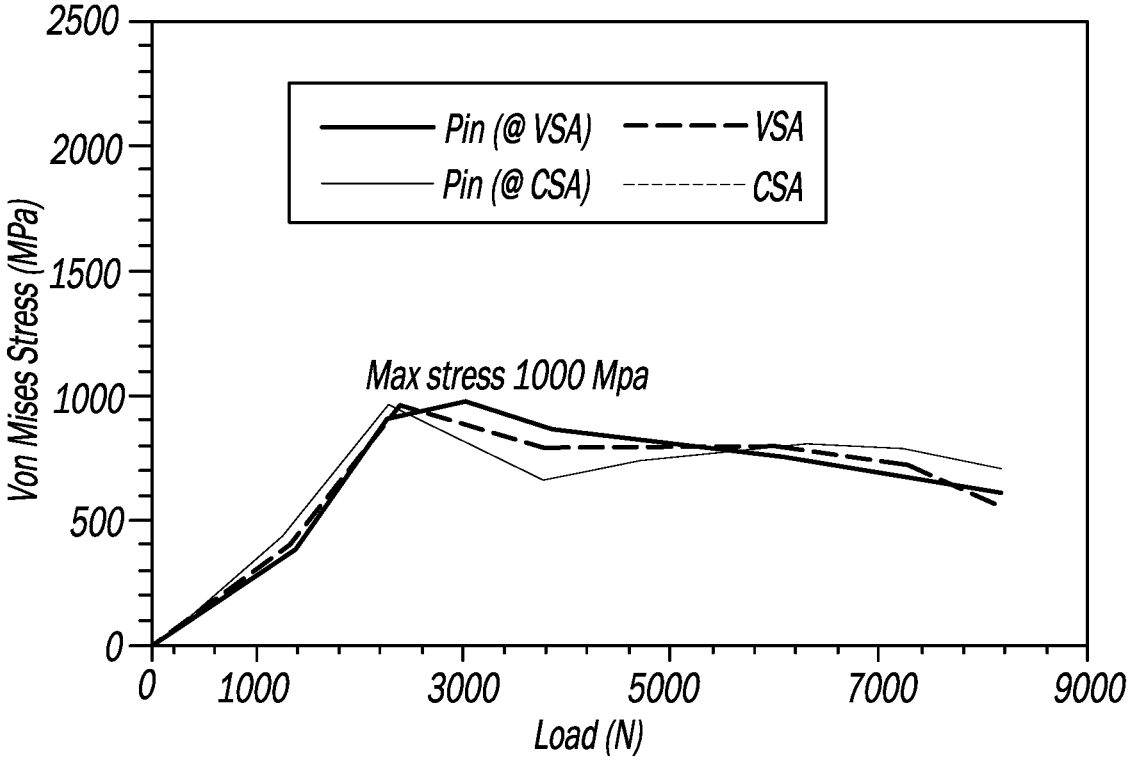
FIG. 25 is a subsurface stress based on load for the configuration of FIGS. 23 and 24.

A latch pin 654 constructed in accordance to additional features and shown in FIGS. 23 and 24 will be described. The latch pin 654 includes a tilt or taper on the outer diameter. A first tilt or taper 680 can define a surface that tapers toward the valve side arm 540A. A second tilt or taper 682 can define a surface that tapers away from the valve side arm 540A. In the example shown the first taper 680 can define an angle 690 relative to a line parallel to the axis of the latch pin 654. The second taper 682 can define an angle 692 relative to a line parallel to the axis of the latch pin 654. The angles 690 and 692 can have a taper angle between 0.5 degree and 1 degree. In the example shown the taper is a 0.8 degree taper. A radius or profile 684 can be similar to the taper 620 of the latch piston 558 to reduce the critical shifts when the latch pin 654 is partially engaged. Subsurface stress based on load is represented in FIG. 25.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A type III rocker arm assembly operable in a first mode and a second mode, the rocker arm assembly selectively opening first and second engine valves based on rotation of a cam shaft having a first cam lobe, the rocker arm assembly comprising:

a rocker shaft;

a first rocker arm assembly configured to receive the rocker shaft and to rotate around the rocker shaft in the first mode based on engagement with the first cam lobe, the first rocker arm assembly comprising:

a valve side rocker arm defining a valve side rocker arm bore;

a cam side rocker arm defining a cam side rocker arm bore; and a latch pin assembly received by the valve side rocker arm bore and the cam side rocker arm bore, the latch pin assembly selectively coupling the valve side rocker arm to the cam side rocker arm for concurrent movement in the first mode, and decoupling the valve side rocker arm from the cam side rocker arm in the second mode, the latch pin assembly comprising:

a latch pin received by the cam side rocker arm bore, the latch pin including an outer diameter defining a first taper that tapers toward the valve side rocker arm, and a second taper that tapers away from the valve side rocker arm;

a latch piston received by the valve side rocker arm bore;

a plug that selectively translates in the cam side rocker arm bore to a fixed position so as to set a retracted position of the latch pin and to set latch pin depth during operation in the second mode; and a biasing member that biases the latch pin into the valve side rocker arm bore.

2. The rocker arm assembly of claim 1 wherein the cam side rocker arm bore and the valve side rocker arm bore are of equivalent diameter.

3. The rocker arm assembly of claim 2 wherein the plug is threaded into the cam side rocker arm bore.

4. The rocker arm assembly of claim 3, further comprising liquid adhesive disposed between the plug and the cam side rocker arm bore.

5. The rocker arm assembly of claim 2 wherein the valve side rocker arm bore and the cam side rocker arm bore are machined concurrently in an assembled position.

6. The rocker arm assembly of claim 1 wherein the latch piston defines a taper that is configured to urge the latch piston toward the valve side rocker arm when the cam side rocker arm is in motion relative to the valve side rocker arm.

7. The rocker arm assembly of claim 6 wherein the cam side rocker arm further defines a chamfer at an engagement end with the taper of the latch piston.

8. The rocker arm assembly of claim 1 wherein the first and second tapers are about 0.8 degrees.

9. The rocker arm assembly of claim 1 wherein the latch piston comprises an extension portion configured to offset the latch piston away from an end surface of the valve side rocker arm bore.

10. The rocker arm assembly of claim 1 wherein the latch pin comprises a stepped diameter having a first diameter portion that is greater than a second diameter portion.

11. The rocker arm assembly of claim 1 wherein the cam side rocker arm bore and the valve side rocker arm bore are machined concurrently in an assembled position.

12. The rocker arm assembly of claim 1 wherein the second mode comprises cylinder deactivation mode.

13. The rocker arm assembly of claim 1, wherein the first rocker arm assembly is an exhaust rocker arm assembly and wherein the type III rocker arm assembly further comprises a second rocker arm assembly configured for selective engine braking.

14. A type III rocker arm assembly operable in a first mode and a second mode, the rocker arm assembly selectively opening first and second engine valves based on rotation of a cam shaft having a first cam lobe, the rocker arm assembly comprising:

a rocker shaft;

a first rocker arm assembly configured to receive the rocker shaft and to rotate around the rocker shaft in the first mode based on engagement with the first cam lobe, the first rocker arm assembly comprising:

a valve side rocker arm defining a valve side rocker arm bore;

a cam side rocker arm defining a cam side rocker arm bore; and a latch pin assembly received by the valve side rocker arm bore and the cam side rocker arm bore, the latch pin assembly selectively coupling the valve side rocker arm to the cam side rocker arm for concurrent movement in the first mode, and decoupling the valve side rocker arm from the cam side rocker arm in the second mode, the latch pin assembly comprising:

a latch pin received by the cam side rocker arm bore, the latch pin including an outer diameter defining a first taper that tapers toward the valve side rocker arm, and a second taper that tapers away from the valve side rocker arm;

a latch piston received by the valve side rocker arm bore; and a biasing member that biases the latch pin into the valve side rocker arm bore, wherein the latch piston defines a taper that is configured to urge the latch piston toward the valve side rocker arm when the cam side rocker arm is in motion relative to the valve side rocker arm.

15. The rocker arm assembly of claim 14 wherein the cam side rocker arm further defines a chamfer at an engagement end with the taper of the latch piston.

16. The rocker arm assembly of claim 14 wherein the latch piston comprises an extension portion configured to offset the latch piston away from an end surface of the valve side rocker arm bore.

17. The rocker arm assembly of claim 14 wherein the latch pin comprises a stepped diameter having a first diameter portion that is greater than a second diameter portion.

18. The rocker arm assembly of claim 14 wherein the cam side rocker arm bore and the valve side rocker arm bore are machined concurrently in an assembled position.

19. The rocker arm assembly of claim 14 wherein the second mode comprises cylinder deactivation mode.

20. The rocker arm assembly of claim 14 further comprising a second rocker arm assembly, wherein the first rocker arm assembly is an exhaust rocker arm assembly, and the second rocker arm assembly is configured for selective engine braking.

* * * * *